US011441422B2

(12) United States Patent
Kristensen et al.

(10) Patent No.: US 11,441,422 B2
(45) Date of Patent: Sep. 13, 2022

(54) METHODS AND SYSTEMS FOR RESERVOIR CHARACTERIZATION AND OPTIMIZATION OF DOWNHOLE FLUID SAMPLING

(71) Applicant: SCHLUMBERGER TECHNOLOGY CORPORATION, Sugar Land, TX (US)

(72) Inventors: Morten Kristensen, Cambridge, MA (US); Nikita Chugunov, Arlington, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 713 days.

(21) Appl. No.: 16/152,114

(22) Filed: Oct. 4, 2018

(65) Prior Publication Data

US 2019/0106987 A1 Apr. 11, 2019

Related U.S. Application Data

(60) Provisional application No. 62/569,172, filed on Oct. 6, 2017.

(51) Int. Cl.
*E21B 49/10* (2006.01)
*E21B 49/08* (2006.01)

(52) U.S. Cl.
CPC ..... *E21B 49/10* (2013.01); *E21B 49/084* (2013.01); *E21B 49/088* (2013.01); *E21B 49/0875* (2020.05)

(58) Field of Classification Search
CPC ..... E21B 49/10; E21B 49/08; E21B 49/088
See application file for complete search history.

(56) References Cited

U.S. PATENT DOCUMENTS 4,860,581 A 8/1989 Zimmerman et al.
4,936,139 A 6/1990 Zimmerman et al.
6,274,865 B1 * 8/2001 Schroer ..... G01N 21/3577 250/269.1
6,719,049 B2 4/2004 Sherwood et al.
(Continued)

OTHER PUBLICATIONS

Civan, Faruk, A Multi-Phase Mud Filtrate Invasion and Wellbore Filter Cake Formation Model, Oct. 10, 1994, 1-7 (Year: 1994).*
(Continued)

*Primary Examiner* — Lisa M Caputo
*Assistant Examiner* — Alex T Devito
(74) *Attorney, Agent, or Firm* — Trevor G. Grove

(57) ABSTRACT

A method (and corresponding downhole tool) is provided for downhole fluid analysis of formation fluids. The downhole tool is operated to draw live fluid from the formation through the downhole tool and acquire observed sensor measurements of the live fluid (which includes filtrate contamination) that flows through the downhole tool. The observed sensor measurements are used in an inversion process that solves for a set of input parameter values of a computational model that predicts level of filtrate contamination in the live fluid that flows through the downhole tool. The set of input parameter values includes at least one endpoint value for the observed sensor measurements. The set of input parameter values solved by the inversion process can be stored and output for different applications.

27 Claims, 23 Drawing Sheets

(56) References Cited

U.S. PATENT DOCUMENTS

| | | | | |
|---|---|---|---|---|
| 6,964,301 | B2 | 11/2005 | Hill et al. | |
| 7,114,562 | B2 | 10/2006 | Fisseler et al. | |
| 7,263,881 | B2 | 9/2007 | Ramakrishnan | |
| 2010/0294491 | A1* | 11/2010 | Zazovsky | E21B 49/087 166/250.01 |
| 2011/0087459 | A1* | 4/2011 | Zazovsky | E21B 49/10 702/179 |
| 2015/0363520 | A1* | 12/2015 | Bailey | E21B 49/00 703/10 |
| 2016/0216404 | A1 | 7/2016 | Kristensen et al. | |

OTHER PUBLICATIONS

Akram, A. H. et al., "A Model to Predict Wireline Formation Tester Sample Contamination", SPE Reservoir Evaluation & Engineering, 1999, 2(6), pp. 499-505.

Alpak, F. O. et al., "Compositional Modeling of Oil-Based-Mud-Filtrate Cleanup During Wireline Formation Tester Sampling", SPE Reservoir Evaluation & Engineering, 2008, 11(2), pp. 219-232.

Angeles, R. et al., "Prediction of Formation-Tester Fluid-Sample Quality in Highly-Deviated Wells", Petrophysics, 2009, 50(1), pp. 32-48.

Chin, W. C. et al., "Formation Tester Immiscible and Miscible Flow Modeling for Job Planning Applications", presented at the SPWLA 46th Annual Logging Symposium, New Orleans, Louisiana, United States of America, 2005, 16 pages.

Dong, C. et al., "Advances in Downhole Contamination Monitoring and GOR Measurement of Formation Fluid Samples", Paper FF, presented at SPWLA 44th Annual Logging Symposium, Galveston, Texas, United States of America, 2003, 12 pages.

Hammond, P. S. "One- and Two-Phase Flow During Fluid Sampling by a Wireline Tool", Transport in Porous Media, 1991, 6, pp. 299-330.

Hsu, K. et al., "Multichannel Oil-Base Mud Contamination Monitoring Using Downhole Optical Spectrometer", Paper QQQQ, Presented at SPWLA 49th Annual Logging Symposium, Edinburgh, Scotland, United Kingdom, 2008, 13 pages.

Jansen J. D., et al., "Closed-Loop Reservoir Management", SPE 119098, presented at the SPE Reservoir Simulation Symposium, The Woodlands, Texas, United States of America, 2009, 18 pages.

Kristensen, M. et al. "Flow Modeling and Comparative Analysis for a New Generation of Wireline Formation Tester Modules", IPTC 17385, presented at the International Petroleum Technology Conference, Doha, Qatar, 2014, 14 pages.

Kristensen, M. et al., "Fast Proxy Models for Probabilistic Evaluation of Downhole Fluid Sampling Operations", presented at the European Conference on the Mathematics of Oil Recovery (ECMOR XV), Amsterdam, The Netherlands, 2016, 17 pages.

Lee, R. et al., "Real-Time Formation Testing Focused-Sampling Contamination Estimation", Paper LLLL, presented at SPWLA 57th Annual Logging Symposium, Reykjavik, Iceland, 2016, 13 pages.

Malik, M. et al., "History Matching and Sensitivity Analysis of Probe-Type Formation-Tester Measurements Acquired in the Presence of Oil-Base Mud-Filtrate Invasion", Petrophysics, 2007, 48(6), pp. 454-472.

McCalmont, S. et al., "Predicting Pump-Out Volume and Time Based on Sensitivity Analysis for an Efficient Sampling Operation: Prejob Modeling Through a Near-Wellbore Simulator", SPE 95885, presented at the SPE Annual Technical Conference and Exhibition, Dallas, Texas, United Sates of America, 2005, pp. 11 pages.

Mullins, O. C. et al., "Real-Time Determination of Filtrate Contamination During Openhole Wireline Sampling by Optical Spectroscopy", SPE 63071, presented at the SPE Annual Technical Conference and Exhibition, Dallas, Texas, United Sates of America, 2000, 13 pages.

Sherwood J. D., "Optimal probes for withdrawal of uncontaminated fluid samples", Physics of Fluids, 17, 2005, 10 pages.

Skibin, A. et al., "Self-Similarity in Contamination Transport to a Formation Fluid Tester During Cleanup Production", Transport in Porous Media, 2010, 83(1), pp. 55-72.

Zazovsky, A., "Monitoring and Prediction of Cleanup Production During Sampling", SPE 112409, presented at the SPE International Symposium and Exhibition on Formation Damage Control, Lafayette, Louisiana, United Sates of America, 2008, 10 pages.

Zuo, J. Y. et al., "A Beakthrough in Accurate Downhole Fluid Sample Contamination Prediction in Real Time", Petrophysics, 2015, 56(3), pp. 251-265.

* cited by examiner

Raw OD
Filtered OD
OD (Unitless)
0.16
0.14
0.12
0.10
0.08
0.06
0.04
0.02
0

Raw Density
Filtered Density
Density (g/cm3)
0.73
0.72
0.71
0.70
0.69
0.68
0.67
0.66

Raw GOR
Filtered GOR
GOR (ft3/bbl)
900
800
700
600
500
400
300
200
100
0

Raw FVF
Filtered FVF
FVF (Unitless)
1.50
1.45
1.40
1.35
1.30
1.25
0
50k
100k
150k
200k
250k
Pumpout Total Volume (cm3)

METHODS AND SYSTEMS FOR RESERVOIR CHARACTERIZATION AND OPTIMIZATION OF DOWNHOLE FLUID SAMPLING

CROSS-REFERENCE TO RELATED APPLICATIONS

This application claims the benefit of priority under 35 U.S.C. 119(e) to U.S. Provisional Patent Application No. 62/569,172 filed Oct. 6, 2017, the entire contents of which are incorporated herein by reference.

FIELD

The subject disclosure relates to the field of hydrocarbon reservoir characterization and evaluation. Specifically, the subject disclosure relates to downhole fluid sampling operations that acquire formation-fluid samples from a hydrocarbon reservoir and to the evaluation of formation-fluid properties and formation properties based on data recorded during such downhole fluid sampling operations. The subject disclosure also relates to methods of optimizing such downhole fluid sampling operations.

BACKGROUND

Fluid analysis on formation-fluid samples extracted from a hydrocarbon reservoir can be used to understand the properties of fluids contained in the hydrocarbon reservoir. Such properties can include fluid type, chemical composition (e.g., hydrocarbon component fractions), density, viscosity, GOR, and phase properties such as saturation pressure, bubblepoint, pour point and stability of asphaltenes. These properties can be used to estimate reserves, assess hydrocarbon value and optimize production. For example, oil companies can use fluid-analysis results to decide how to complete a well, develop a field, design surface facilities, tie back satellite fields and commingle production between wells.

Fluid analysis is also important for understanding the properties of formation water, which can have significant economic impact. Often, the most crucial goals are to identify the corrosive properties of the water for the purpose of selecting completion materials and to measure scaling potential for avoiding flow-assurance problems. In addition, log analysts want to quantify the salinity of the water for petrophysical evaluation, and geologists and reservoir engineers want to establish the water source for evaluation of reservoir connectivity.

Formation-fluid samples are typically acquired using one of three main techniques. In a first technique, wireline formation testers deployed in an open hole can acquire formation-fluid samples and also perform downhole fluid analysis of the formation-fluid samples. In a second technique, drillstem testers (DSTs) can acquire formation-fluid samples in open hole and also perform downhole fluid analysis of the formation-fluid samples. DSTs are drilling tools with testing/sampling capabilities. DSTs require early planning and a well completion that can withstand production pressures. Examples of drilling tools with testing/sampling capabilities is provided in U.S. Pat. No. 7,114,562. In a third technique, wireline tools deployed in a cased, producing well can acquire formation-fluid samples and perform downhole fluid analysis of the formation-fluid samples.

An important aspect of formation-fluid sampling and testing is analysis of the formation-fluid samples at reservoir conditions. This helps validate sample quality during the sampling process, but also enables the mapping of vertical variations in fluid properties as a function of measured depth, allowing interpreters to determine zonal connectivity and define reservoir architecture early in field life. Uncontaminated fluid samples allow accurate measurement of fluid properties both downhole and at the surface.

After formation-fluid samples are collected by a downhole tool, they are typically analyzed in laboratories, where they undergo a series of tests depending on the client's needs. Standard tests can measure chemical composition, gas/oil ratio (GOR), density, viscosity, and phase properties such as saturation pressure, bubblepoint, pour point and stability of asphaltenes. Several measurements can also be performed by downhole fluid analysis that uses optical spectroscopy to characterize fluid properties of the extracted formation-fluid samples under reservoir conditions, such as optical density, mass-density, GOR and chemical composition.

The laboratory and downhole fluid analysis require that fluid from the hydrocarbon reservoir be drawn into the downhole tool for testing and/or sampling. Various devices, such as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 4,860,581; 4,936,139; 6,719,049 and 6,964,301.

Laboratory and downhole fluid analysis require uncontaminated formation-fluid samples (that is a formation-fluid with a sample with a sufficiently low level of contamination such that the formation-fluid sample is representative of the formation fluid). Contamination occurs when miscible drilling fluid filtrate that has invaded the formation mixes with the formation fluid being sampled. For instance, samples of hydrocarbon fluid are contaminated by oil-based mud (OBM) filtrate, and samples of formation water are contaminated by water-based mud (WBM) filtrate.

Various challenges arise in the process of minimizing the contamination in the formation-fluid samples extracted from the formation, which is typically referred to as cleanup. In a typical cleanup process, as the downhole tool withdraws fluid from the formation through the probe, the initial formation fluid to enter the flowline of the downhole tool is contaminated with filtrate from the drilling fluid. The level of contamination is monitored in real time by optical spectroscopic analyzers of the downhole tool and it decreases over time as the volume of formation fluid extracted from formation increases. Depending on a number of factors (such as formation permeability, anisotropy, amount of invasion, formation-fluid viscosity, pumping time, rate and pressure drawdown), the contamination level may or may not decrease sufficiently to allow collection and/or testing of one or more uncontaminated formation-fluid samples. For example, filtrate contamination from deeply invaded zones may continue to feed into the sampling probe. Achieving sufficiently low levels of contamination may require withdrawal of formation fluid for extended periods of time (e.g., many hours), which can be expensive in terms of rig time and increased exposure to sticking in an open hole environment.

Downhole tools can employ optical sensors that measure the optical absorption spectrum difference between the reservoir fluid and drilling mud filtrate. This is the basic principle underlying optics-based contamination monitoring, which continuously monitors the fluid that is drawn into the flowline of the downhole acquisition tool until a desired low level of filtrate contamination is achieved. Quantifying filtrate contamination from optical density (OD) measurements requires knowledge of the OD of clean filtrate and formation fluid. In OBM contamination monitoring (OCM) algorithms, these so-called OD endpoints are typically estimated by fitting and extrapolating a simple power-law model to the OD measurements as described below with respect to Eqn. 2. However, in difficult sampling environments and for downhole tools with focused sampling hardware with active guarding of filtrate flow, the assumption of a simple power-law model is not valid.

Several authors have studied the contamination cleanup problem during fluid sampling. Hammond, P. S., "One- and two-phase flow during fluid sampling by a wireline tool," Transport in Porous Media, 6:299-330, 1991 presented approximate analytical models for both miscible and immiscible contamination cleanup through a standard probe. The models explained the late-time asymptotic behavior where the produced contamination decreases as $t^{2/3}$. Also using analytical techniques, Ramakrishnan in U.S. Pat. No. 7,263,881 and Sherwood, J. D., "Optimal probes for withdrawal of uncontaminated fluid samples," Physics of Fluids, 17, 2005, proposed optimal designs for focused sampling probes, where the formation fluid flowing to an inner sampling probe is guarded by an outer concentric probe, thus greatly reducing the contamination at the inner probe and thereby the time required to collect an uncontaminated sample. Malik et al., "History matching and sensitivity analysis of probe-type formation-tester measurements acquired in the presence of oil-base mud-filtrate invasion," Petrophysics, 48(6):454-472, 2007, used a compositional numerical simulation model to history match observed pressure and gas-oil-ratio (GOR) during oil sampling in OBM conditions using a conventional probe.

This work was extended to focused probes and deviated wellbores by Angeles et al., "Prediction of formation-tester fluid-sample quality in highly-deviated wells," Petrophysics, 50(1):32-48, 2009. Chin and Proett, "Formation tester immiscible and miscible flow modeling for job planning applications," Presented at the SPWLA 46th Annual Logging Symposium, New Orleans, La., USA, 26-29 Jun. 2005 and McCalmost et al., "Predicting pump-out volume and time based on sensitivity analysis for an efficient sampling operation: Pre-job modeling through a near-wellbore simulator," SPE 95885: Presented at the SPE Annual Technical Conference and Exhibition, Dallas, Tex., USA, 9-12 Oct. 2005, address the specific needs in pre-job sampling planning and present special-purpose numerical simulators for cleanup simulation.

Among the full-physics cleanup models requiring numerical solution, only a few authors have addressed efficient approximation techniques which can make the solutions available for use in rapid job planning workflows, uncertainty quantification, and real-time inversion. Zazovsky, SPE 112409: Presented at the SPE International Symposium and Exhibition on Formation Damage Control, Lafayette, La., USA, 13-15 Feb. 2008, and Skibin and Zazovsky, "Self-similarity in contamination transport to a formation fluid tester during cleanup production," Transport in Porous Media, 83:55-72, 2010, studied behaviors of miscible cleanup by a conventional probe. Based on identification of characteristic signatures on the cleanup curve (formation fluid breakthrough and transition between circumferential and vertical cleanup regimes), they constructed simple type curves for the cleanup process and demonstrated their use in contamination monitoring. The specific solution structure limited their methodology to cleanup by a probe positioned away from formation boundaries.

Akram et al., "A model to predict wireline formation tester sample contamination," SPE Reservoir Eval. & Eng., 2(6):499-505, 1999, developed a correlation for prediction of cleanup time for sampling of oil by a probe in WBM conditions. They used a correlation structure based on the analytical solution developed in (Hammond, 1991) and extended it to account for viscosity contrast, ratio between endpoint relative permeabilities, and distance to bed boundaries.

Finally, Alpak et al., "Compositional modeling of oil-based-mud-filtrate cleanup during wireline formation tester sampling," SPE Reservoir Eval. & Eng., 11(2):219-232, 2008 developed a proxy model for OBM cleanup during sampling using a conventional probe. They used a third order polynomial dependence between $\log_{10} F$ and $\log_{10} V$, where F is the fraction of produced contamination and V is the pumped volume. The polynomial coefficients were fitted to match contamination results from full-scale numerical simulations.

The basic principles of OBM-filtrate contamination monitoring with optical measurements is based on the Beer-Lambert law. See Dong et al., "Advances in downhole contamination monitoring and GOR measurement of formation fluid samples," Paper FF: Presented at SPWLA 44th Annual Logging Symposium, Galveston, Tex., USA, 22-25 Jun. 2003. For a fully miscible binary mixture of formation oil and mud filtrate, the optical density $OD_\lambda$ measured at a wavelength channel $\lambda$ is calculated by the following mixing rule:

$$OD_\lambda = \eta OD_f + (1\eta) OD_o, \tag{1}$$

where $\eta$ is the OBM filtrate contamination level which is representation as a volume fraction of OBM filtrate in a live fluid, $OD_o$ is the OD endpoint for the virgin formation fluid, and $OD_f$ is the OD endpoint for pure OBM filtrate.

Downhole quantification of OBM contamination requires estimates of the properties of the virgin (or uncontaminated) reservoir fluid and pure OBM filtrate. One of the main challenges in real-time OBM contamination monitoring is that these properties, usually referred to as endpoints, cannot be measured directly in practice. Mullins and Schroer, "Real-time determination of filtrate contamination during openhole wireline sampling by optical spectroscopy," SPE 63071: Presented at the SPE Annual Technical Conference and Exhibition, Dallas, Tex., USA, 1-4 Oct. 2000, fitted OD measured with a spectrometer at specified wavelengths to a power-law $$OD(t) = \alpha - \beta t^{\gamma}, \tag{2}$$

where t is the time (assuming a constant pump rate), $\alpha$ and $\beta$ are the two adjustable parameters, and $\gamma$ is a fixed exponent.

Extrapolating t to infinity, one can obtain the OD endpoint of the virgin reservoir fluid. It is assumed that the OD endpoint of mud filtrate at a specified color and/or methane channel is equal to zero.

For variable pump rate, Eqn. 2 can be rewritten in terms of pump-out volume V, rather than time t. Multichannel OCM algorithms based on synchronized OD measurements at multiple channels provides significant improvement over single channel interpretation (see Hsu et al., "Multichannel oil-base mud contamination monitoring using downhole optical spectrometer," SPWLA 49th Annual Logging Symposium, Edinburgh, Scotland, United Kingdom, 25-28 May 2008. However, the accuracy of the endpoint characterization is still limited if there is no or minimal optical density contrast between the oil and the filtrate. This is typically the case when mud systems absorb color due to well-to-well reuse or if the native fluid lacks color.

Multi-sensor OCM workflows have been proposed by Zuo et al., "A breakthrough in accurate downhole fluid sample contamination prediction in real time," Petrophysics, 56(3):251-265, 2015. Such workflows use mixing rules similar to Eq. 1 for mass density, optical density, single-flash shrinkage factor, and gas-oil ratio (GOR).

Specifically, for mass density, the following linear mixing rule holds:

$$\rho=\eta\rho_f+(1\eta)\rho_o, \tag{3}$$

where $\rho$ is the mass density of the sampled fluid, $\rho_f$ is a density endpoint of the filtrate, and $\rho_o$ is the density endpoint for uncontaminated formation fluid.

For single-flash shrinkage factor b:

$$b=\eta b_f+(1\eta)b_o, \tag{4}$$

where b is the shrinkage factor of the sampled fluid, $b_f$ is a shrinkage factor endpoint of the filtrate, and $b_o$ is shrinkage factor endpoint for uncontaminated formation fluid.

Similar mixing rules can be derived for GOR via an auxiliary f-function as presented in Zuo et al., 2015:

$$f=\eta f_f+(1\eta)f_o, \tag{5}$$

where $f=GOR_o-(GOR_o-GOR)b/b_f$, $f_f$ is a f-function endpoint of the filtrate, and $f_o$ is the f-function endpoint for uncontaminated formation fluid.

However, the empirical fixed-exponent power law presented in Eqn. 2 has practical limitations and cannot be universally applied in OCM interpretation. FIGS. 1A, 1B, and 1C provide examples of deviation from the power-law observed for various types of downhole tools and downhole environments. For a downhole tool employing a dual-packer configuration, a large sump volume can cause significant delay in the late-time switch to $V^{-2/3}$ mode as shown in FIG. 1A. For a downhole tool employing a three-dimensional radial probe, late-time $V^{-2/3}$ cleanup regime can be affected by the thickness of the sampled reservoir zone, as illustrated by FIG. 1B. For a downhole tool with a circular probe, the viscosity ratio effects the early-time $V^{-5/12}$ cleanup regime as shown in FIG. 1C. Moreover, the OCM interpretation for a downhole tool with focused sampling hardware with active guarding of filtrate flow is even more challenging, since the power-law model of Eq. 2 is not applicable in this case as presented by Lee et al., "Real-time formation testing focused sampling contamination estimation," SPWLA 57th Annual Logging Symposium, Reykjavik, Iceland, Jun. 25-29, 2016.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method (and corresponding downhole tool and sampling systems) is provided for downhole fluid analysis of formation fluids. The downhole tool is operated to draw live fluid from the formation through the downhole tool and acquire observed sensor measurements of the live fluid (which includes filtrate contamination) that flows through the downhole tool. The observed sensor measurements are used in an inversion process that solves for a set of input parameter values of a computational model that predicts level of filtrate contamination in the live fluid that flows through the downhole tool. In one application, the computational model can be a proxy model developed following the algorithms disclosed in U.S. Patent Publ. No. 2016/0216404. The set of input parameter values includes at least one endpoint value for the observed sensor measurements. The set of input parameter values solved by the inversion process can be stored and output for different applications.

In one application, the set of input parameter values solved by the inversion process can be used to calibrate the computational model. The calibrated computational model can be used to predict level of filtrate contamination in the live fluid, and the predicted level of filtrate contamination can be compared to a threshold level. At least one operational action of the downhole tool can be formed in response to the comparing. In embodiments, the threshold level can indicate that the live fluid is sufficiently clean, and the at least one operational action can be selected from the group consisting of: fluid analysis measurements of the live fluid, collection of at least one sample of the live fluid, and combinations thereof.

In another application, the set of input parameter values can be used to calibrate the computational model, and the calibrated computational model can be used to determine at least one optimized rate of fluid flow through the downhole tool which minimizes a predicted remaining cleanup time required to reach a predetermined threshold contamination level. Real-time control of the downhole tool can be performed such that the flow rate of the live fluid drawn through the downhole tool matches the at least one optimized rate.

In embodiments, the computational model predicts the level of filtrate contamination as a function of cleanup time and pumped cleanup volume and thus can be used to forward model the observed sensor measurements. The sensor data can then be inverted in real time to provide contamination predictions.

In embodiments, the computational model can be a proxy model that is trained on and thoroughly vetted against a large number of full-scale numerical simulations. Compared to existing algorithms, contamination monitoring methods that employ the proxy models as described herein are applicable for all types of downhole sampling hardware and a wider set of operating conditions. By directly relying on a proxy model of the cleanup process, the physical properties of the formation and fluids (such as porosity, permeability, viscosity, and depth of filtrate invasion) can be estimated by the results of the inversion, thus providing additional valuable information for formation evaluation. Moreover, real-time computation is enabled through fast, high-fidelity proxy models for the cleanup operations. Furthermore, optimum sampling strategies for downhole tools employing focused sampling hardware in the presence of formation and fluid property uncertainty is also provided.

In embodiments, a method for the real-time sampling optimization is provided when the live fluid is monitored using DFA sensors (e.g., optical spectrometers and other possible DFA fluid sensors). Measurements from the DFA sensors are used to infer the amount of filtrate contamination in the produced live fluid via the inversion results of a proxy model, thus enabling real-time optimum control of the sampling process. The optimization results show that sampling time savings of up to five hours are possible compared to a default, fixed-rate strategy, especially in environments characterized by a high viscosity contrast between formation fluid and mud filtrate. These savings translate directly into rig time savings for the operator. In general, the results provide guidance on optimum focused-sampling operation in different environments. The disclosure demonstrates how these optimum strategies may be implemented as part of an optimum control algorithm using real-time DFA measurements.

Other aspects and advantages of the invention will be apparent from the following description and the appended claims.

BRIEF DESCRIPTION OF THE DRAWINGS

Certain embodiments of the disclosure will hereafter be described with reference to the accompanying drawings, where like reference numerals denote like elements. It should be understood, however, that the accompanying figures illustrate the various implementations described herein and are not meant to limit the scope of various technologies described herein.

FIG. 1A shows the sump volume effect for a downhole sampling tool that employs a dual-packer; FIG. 1B shows the zone thickness effect for a downhole sampling tool that employs a three-dimensional radial probe; and FIG. 1C shows the viscosity ratio effect for a downhole sampling tool that employs a circular probe;

FIG. 3A is a plot of the synthetic OD data and the predicted OD values that are solved by 50 different inversion operations over an interval of the cleanup volume. The synthetic OD measurements are generated by adding 3% relative noise to the synthetic OD data. FIG. 3B shows the values of the input vector parameters $k_v/k_h$ and $\mu_o/\mu_f$ solved by 50 different inversion operations. FIG. 3C shows the values of the input vector parameters for the formation thickness H and the OD endpoint for the virgin oil $OD_o$ solved by 50 different inversion operations. FIG. 3D is a plot of the synthetic filtrate contamination levels and predicted filtrate contamination levels that are solved by 50 different inversion operations over the interval of the cleanup volume. FIG. 3E shows the values of the input vector parameter for the invasion depth $R_{inv}$ and the formation porosity solved by the 50 different inversion operations. FIG. 3F shows the values of the input vector parameters $\mu_o$ and $\mu_f$ solved by 50 different inversion operations;

FIG. 5A is a plot of the synthetic OD data and the predicted OD values for the sample line and guard line that are solved by 50 different inversion operations over an interval of the cleanup volume. FIG. 5B shows the values of the input vector parameters $k_v/k_h$ and $\mu_o/\mu_f$ solved by 50 different inversion operations. FIG. 5C shows the values of the input vector parameters for the formation thickness H and the OD endpoint for the virgin oil $OD_o$ solved by 50 different inversion operations. FIG. 5D is a plot of the synthetic filtrate contamination levels and predicted filtrate contamination levels for the sample line and guard line that are solved by 50 different inversion operations over the interval of the cleanup volume. FIG. 5E shows the values of the input vector parameter for the invasion depth $R_{inv}$ and the formation porosity solved by the 50 different inversion operations. FIG. 5F shows the values of the input vector parameters $\mu_o$ and $\mu_f$ solved by 50 different inversion operations;

FIG. 5G is a plot of the synthetic OD data and the predicted OD values for the sample line and guard line that are solved by 50 different inversion operations over an interval of the cleanup volume. FIG. 5H shows the values of the input vector parameters $k_v/k_h$ and $\mu_o/\mu_f$ solved by 50 different inversion operations. FIG. 5I shows the values of the input vector parameters for the formation thickness H and the OD endpoint for the virgin oil $OD_o$ solved by 50 different inversion operations. FIG. 5J is a plot of the synthetic filtrate contamination levels and predicted filtrate contamination levels for the sample line and guard line that are solved by 50 different inversion operations over the interval of the cleanup volume. FIG. 5K shows the values of the input vector parameter for the invasion depth $R_{inv}$ and the formation porosity solved by the 50 different inversion operations. FIG. 5L shows the values of the input vector parameters $\mu_o$ and $\mu_f$ solved by 50 different inversion operations;

FIG. 6A depicts optical density (OD) sensor measurements as a function of cleanup volume. FIG. 6B depicts mass density sensor measurements as a function of cleanup volume. FIG. 6C depicts gas-oil-ratio (GOR) sensor measurements as a function of cleanup volume. FIG. 6D depicts formation-volume-factor (FVF) sensor measurements as a function of cleanup volume;

FIG. 8A shows the values of the input vector parameters $k_v/k_h$ and $\mu_o/\mu_f$ solved by the different inversion operations. FIG. 8B shows the values of the input vector parameter for the invasion depth $R_{inv}$ and the formation porosity solved by the different inversion operations. FIG. 8C shows the values of the input vector parameters for the OD endpoint for the filtrate ($OD_{mf}$) for the OD endpoint for the formation fluid ($OD_{oil}$) solved by the different inversion operations;

DETAILED DESCRIPTION

Figure 1A:
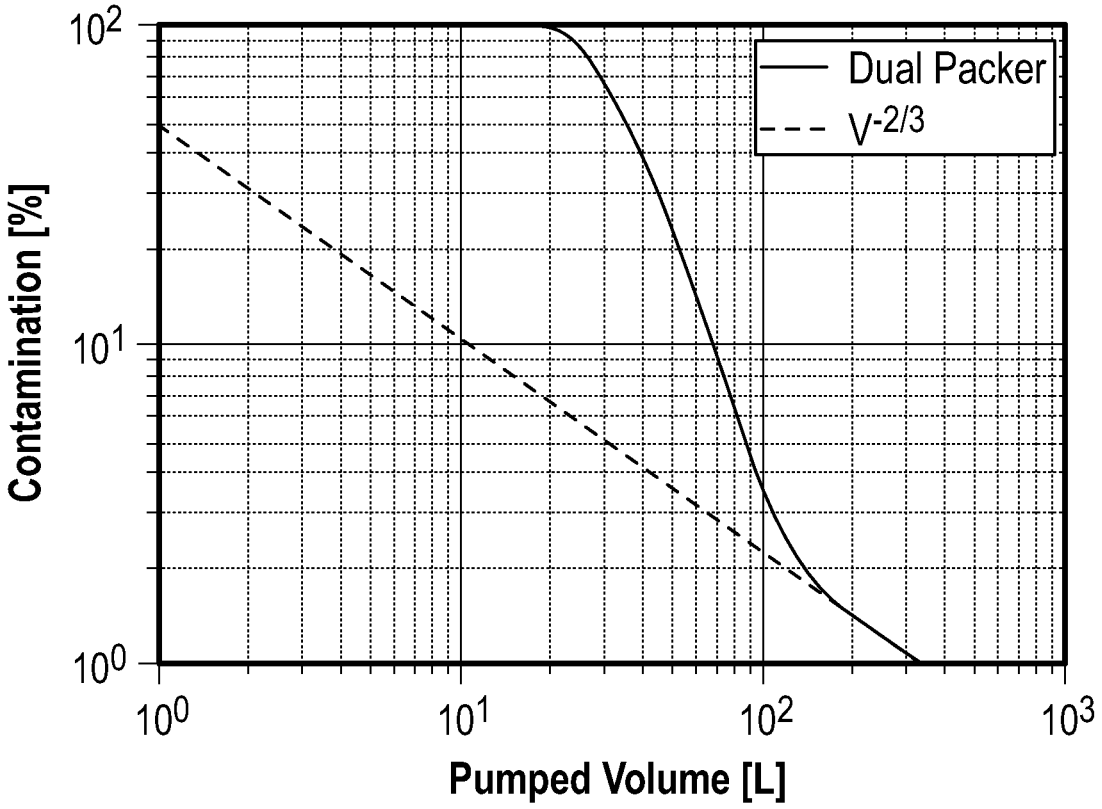
FIGS. 1A, 1B and 1C depicts examples of deviations from the fixed power law cleanup regime for various types of downhole sampling tools.
Figure 1B:
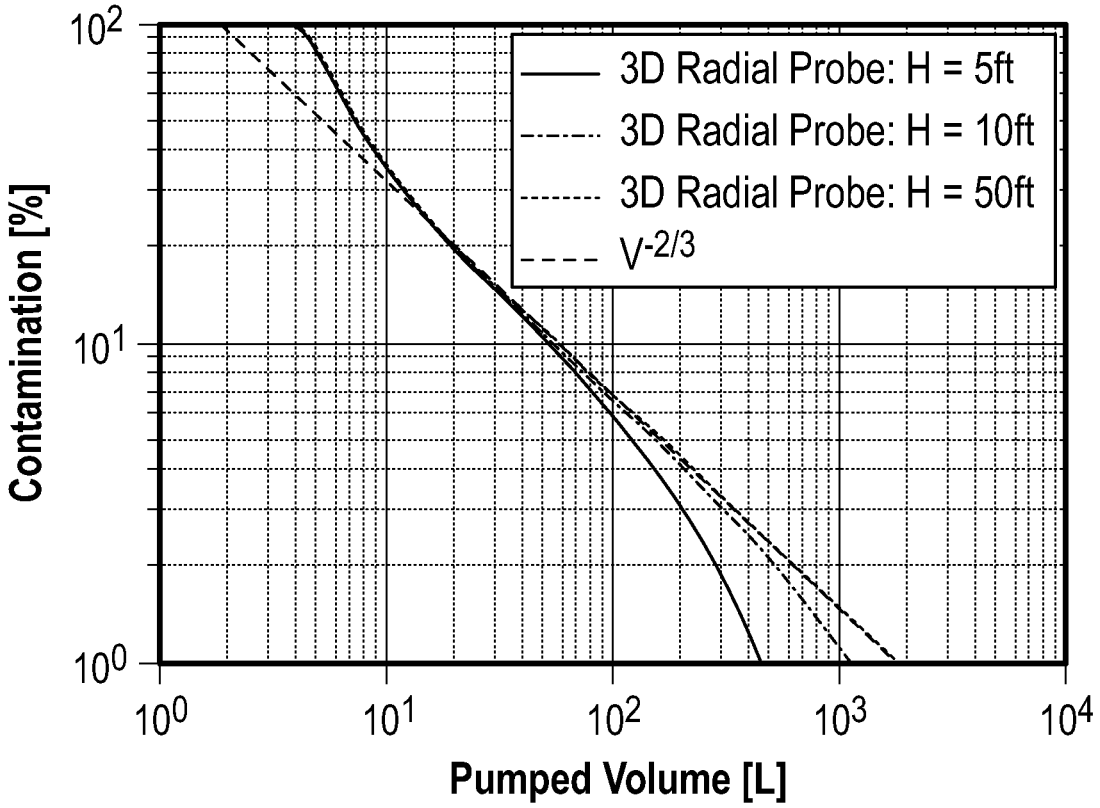
Figure 1C:
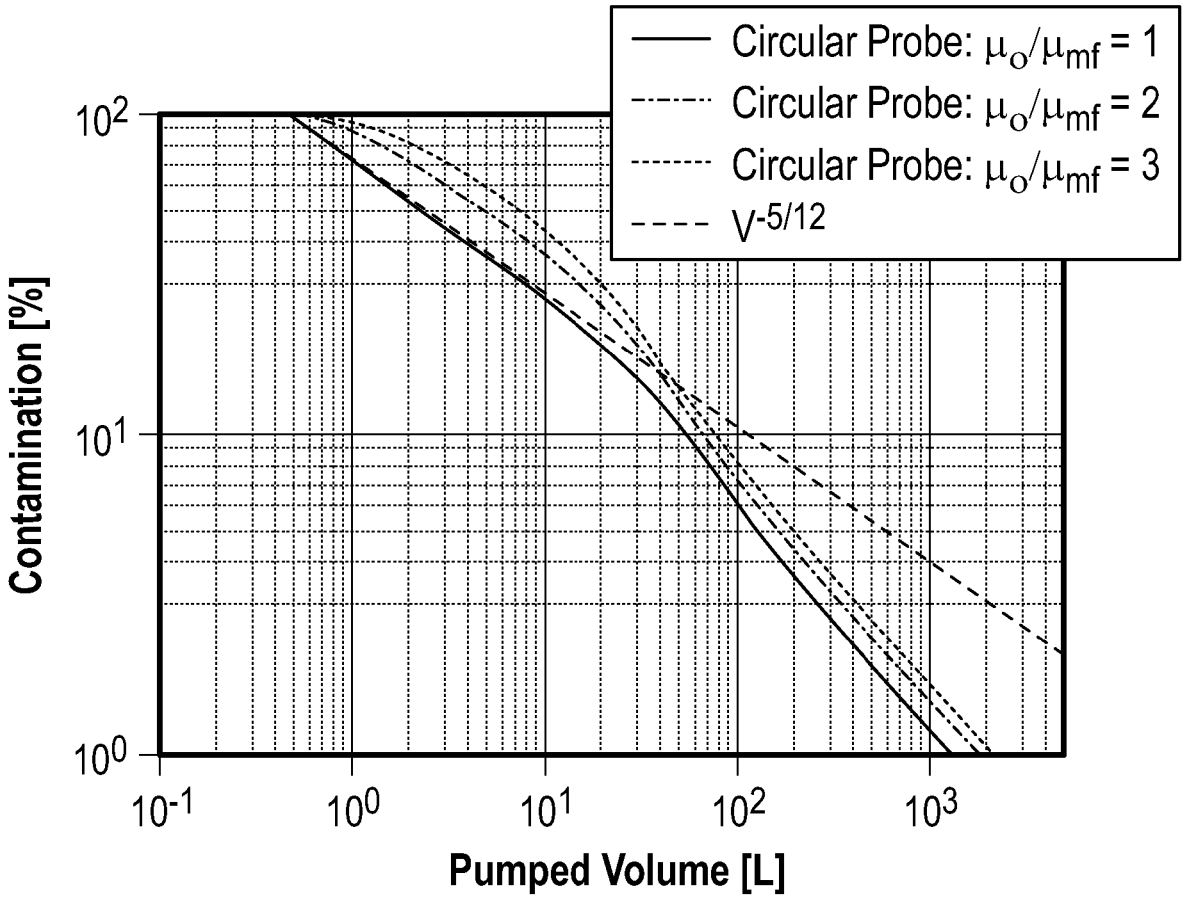

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

The methods of the present disclosure employ a proxy model for cleanup operations of a reservoir fluid sampling process carried out by a downhole sampling tool. The proxy model is a set of parametric functions (such as mathematical equations or response surfaces) that is configured to mimic or represent the output response of a numeric simulation of the cleanup operations.

In embodiments, the proxy model can be used to characterize the cleanup operations at a constant pump rate (i.e., a constant flow rate of fluid drawn from the formation into the downhole tool) based on a number of input parameter values. In this case, the proxy model approximates the functional relationship between cleanup volume (i.e., the volume of live fluid drawn from the formation into the downhole tool) and filtrate concentration level (i.e., volume fraction of the filtrate in live fluid) over relevant ranges of the input parameters for a number of different pump rates. Thus, for a given a pump rate, the proxy model approximates the functional relationship between cleanup volume and filtrate concentration level over relevant ranges of the input parameters. It can also approximate the functional relationship between cleanup time and filtrate concentration level as the cleanup time is related to the cleanup volume by the pump rate (i.e., cleanup time=cleanup volume/pump rate).

In embodiments, the input parameters of the proxy model can include an OD endpoint value for the uncontaminated or virgin formation fluid and possibly an OD endpoint value for filtrate, if necessary. In this case, these OD endpoint value(s) are unknowns that are solved by inversion of the proxy model as described herein. Alternatively, the OD endpoint for the filtrate can be represented by a fixed value that is known or measured and used as part of the proxy model. The OD endpoint value for the virgin formation fluid and the OD endpoint value for the filtrate allows the proxy model to calculate a predicted OD value directly from Eqn. (1).

In embodiments, the input parameters of the proxy model can also include endpoint values for other fluid sensor measurements of the downhole tool, such as mass density, shrinkage factor and GOR. In this case, these endpoint value(s) are unknowns that are solved by inversion of the proxy model as described herein. Note that such endpoint values allow the proxy model to calculate predicted fluid sensor measurements for mass density, shrinkage factor and GOR directly from Eqns. (3), (4), and (5) as applicable.

In embodiments, the proxy model can employ a vector of input parameters that characterize rock properties of the formation, properties of the formation fluid and properties of the wellbore environment. For example, the proxy model can include following input parameterization for prediction of filtrate concentrations levels during cleanup:

$$p=[\ln k_v/k_h, \ln \mu_o/\mu_f, \ln R_{inv}, \ln D_w, \ln H/(k_v/k_h)^{1/2}, z]^T, \quad (6)$$

where p is the vector of input parameters, $k_v/k_h$ is the dimensionless ratio of the vertical permeability $k_v$ of the formation to the horizontal permeability $k_h$ of the formation, $\mu_o/\mu_f$ is the dimensionless ratio of the uncontaminated formation fluid viscosity $\mu_o$ to the filtrate viscosity $\mu_f$, $R_{inv}$ is the radius of filtrate invasion (measured from the borehole wall), $D_w$ is the wellbore diameter, H is the formation thickness, and z is the relative tool distance from the top of formation, i.e. z=h/H, and T is the transpose operator.

Note that because the cleanup volume is proportional to formation porosity, the formation porosity can be treated as a scaling factor and not as an independent parameter for use in predicting filtrate concentration levels during cleanup.

In embodiments, the proxy model can predict filtrate concentration levels as function of cleanup volume by a kriging-type model which is fit to responses output by numeric simulation of the cleanup process. For example, the proxy model can be of the form:

$$\hat{V}_p(p)=a^T f(q,p)+b^T f(p) \quad (7)$$

where $\hat{V}_p$ denotes the kriging prediction of cleanup volume at a given level of filtrate contamination, p denotes the vector of input parameters, T is the transpose operator, $f(p)$ denotes a regression part of the model that includes low order polynomials and that accounts for a global trend in the modeled data, $f(q,p)$ denotes a correlation part of the model, and a and b denote kriging model parameters that are estimated by fitting the responses from numeric simulation.

Details of numeric simulations that model the cleanup process as a single-phase flow with contaminate transport along with methods that fit responses (or solutions) produced by numeric simulation of a true model to solve for a kriging-type proxy model of the cleanup process is set forth in U.S. Patent Publ. No. 2016/0216404, commonly assigned to the assignee of the present disclosure and incorporated by reference herein its entirety.

Furthermore, the proxy model can use the predicted filtrate concentration level at a given cleanup volume to determine one or more predicted sensor measurements using appropriate sensor measurement endpoint values. For example, the proxy model can use the predicted filtrate concentration level in conjunction with OD endpoint values $OD_o$, $OD_f$ for clean formation fluid and the filtrate to determine a predicted OD sensor measurement value using Eqn. (1) above. Similarly, the proxy model can use the predicted filtrate concentration level in conjunction with mass density endpoint values $\rho_o$, $\rho_f$ for clean formation fluid and the filtrate to determine a predicted mass density sensor measurement value using Eqn. (3). Similarly, the proxy model can use the predicted filtrate concentration level in conjunction with shrinkage factor endpoint values $b_o$, $b_f$ for clean formation fluid and the filtrate to determine a predicted shrinkage factor sensor measurement value using Eqn. (4). Similarly, the proxy model can use the predicted filtrate concentration level in conjunction with the f-function endpoint values $f_o$, $f_f$ for clean formation fluid and the filtrate to determine a predicted f-function sensor measurement value using Eqn. (5). Note that for these calculations, one or more of the various sensor measurement endpoint values (e.g., the OD endpoint values $OD_o$, $OD_f$, the mass density endpoint values $\rho_o$, $\rho_f$, the shrinkage factor endpoint values $b_o$, $b_f$, and the f-function endpoint values $f_o$, $f_f$) can be treated as inputs to the proxy model and solved for by inversion of the proxy model as described herein In embodiments, the proxy model of the cleanup process can be based on neutral networks (including recurrent neural networks) as well as tree-based regression.

In embodiments, the proxy model can be deterministic in nature and thus can be configured to characterize without uncertainty the functional relationship between cleanup volume and filtrate concentration level over relevant ranges of the input parameters for a number of different pump rates. Alternatively, the proxy model can be configured to characterize uncertainty with regard to the functional relationship between cleanup volume and filtrate concentration level over relevant ranges of the input parameters for a number of different pump rates as described in detail in U.S. Patent Publ. No. 2016/0216404.

In embodiments, the proxy model as described herein can be used for real-time contamination monitoring during the cleanup operations of a reservoir fluid sampling process. In particular, the proxy model can be used as part of an inversion process that solves for the input parameters of the proxy model. As described above, such input parameters can include formation rock parameters (such as the dimensionless ratio $k_v/k_h$) and/or formation-fluid parameters (such as the dimensionless ratio $\mu_o/\mu_f$, optical density endpoints $OD_f$ and $OD_o$ and possibly other sensor measurement endpoint values) and/or wellbore parameters (such as $R_{inv}$, $D_w$ and z).

Figure 2:
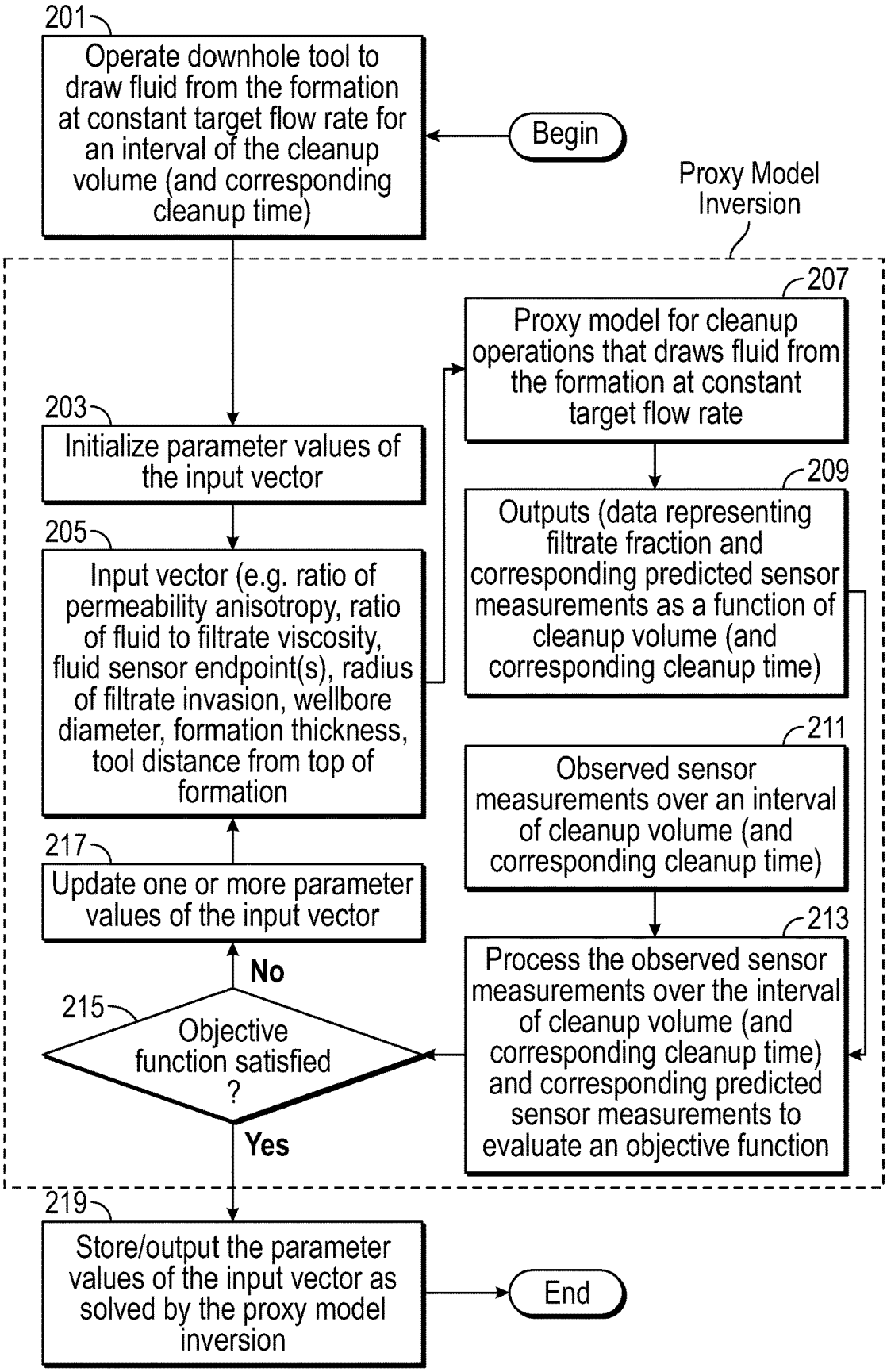
FIG. 2 is a flow chart of an exemplary proxy model inversion process.
Figure 3A:
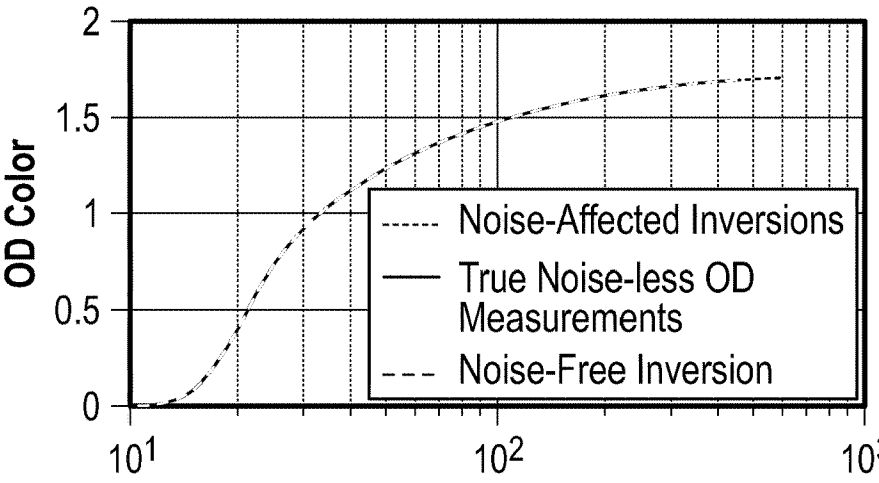
FIGS. 3A-3F depict inversion results for proxy model inversion processing similar to FIG. 2 and applied to synthetic data for the cleanout operations of a fluid sampling process carried out by a three-dimensional radial probe.
Figure 3B:
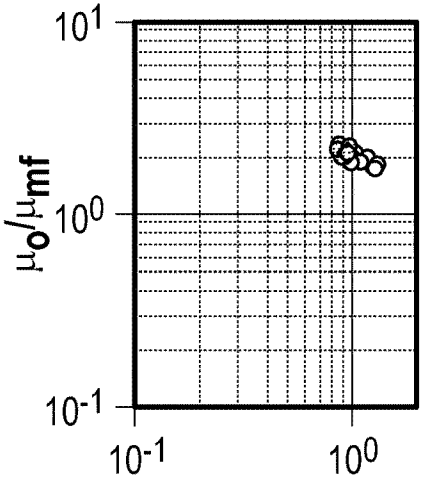
Figure 3C:
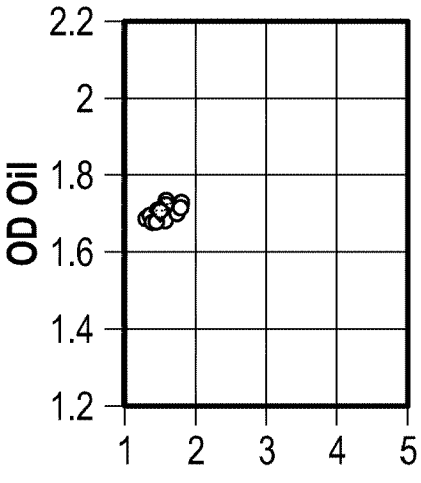
Figure 3D:
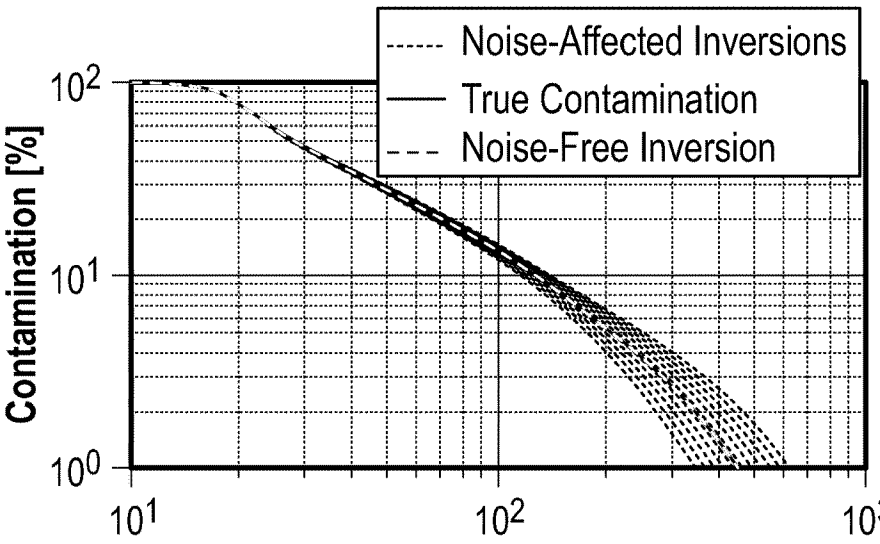
Figure 3E:
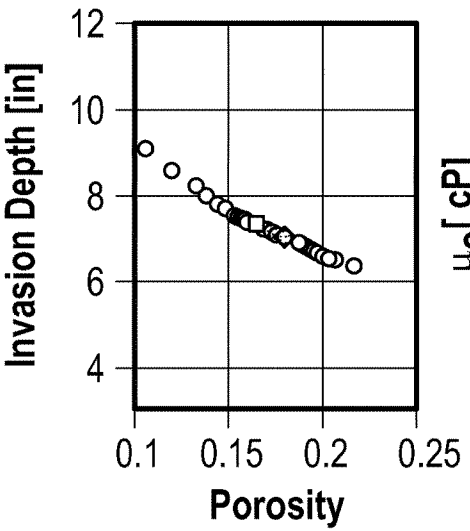
Figure 3F:
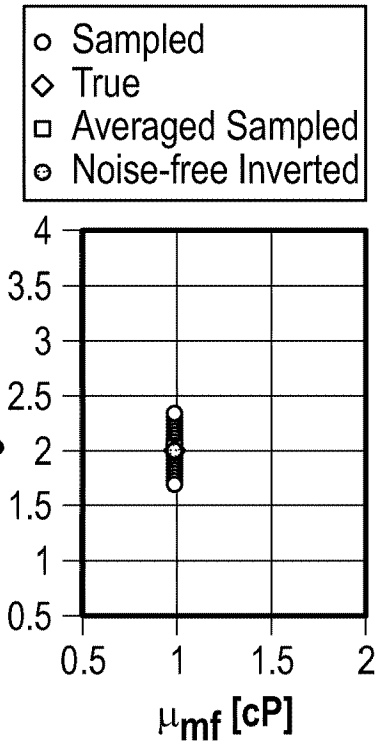

FIG. 2 is a flow chart that illustrates an example inversion process that solves for the input parameters of the proxy model.

The operations begin in block 201 where the downhole tool is operated to draw live fluid from the formation at a constant target flow rate for an interval of the cleanup volume (or for a corresponding time interval of cleanup time). The interval of the cleanup volume is related to a corresponding time interval of cleanup time by the constant target flow rate (i.e., cleanup volume=constant flow rate cleanup time). For example, in a downhole tool with focused sampling hardware that includes a sample line and a guard line (e.g., FIGS. 11, 12, 13, 14A, 14B), the downhole tool can be operated to draw live fluid from the formation at a constant target flow rate for a predetermined time interval (i.e., the first 60 minutes) of the cleanup time, where the constant target flow rate is the combination of a constant target flow rate $Q_s$ for the sample line and a constant target flow rate $Q_g$ for the guard line.

In block 203, the parameter values of the input vector of the proxy model are initialized. Such initial values can be based on known values given by tables or lab measurements or based on values measured by other downhole measurements and analysis. In embodiments, the input parameters can include formation rock parameters (such as the dimensionless ratio $k_v/k_h$) and/or formation-fluid parameters (such as the dimensionless ratio $\mu_o/\mu_f$, optical density endpoints $OD_f$ and $OD_o$ and possibly other sensor measurement endpoint values) and/or wellbore parameters (such as $R_{inv}$, $D_w$ and z).

In block 205, the input vector for the proxy model is generated according to the initial parameter values specified in block 203.

In block 207, the input vector generated in block 205 is input to the proxy model, and the proxy model outputs data representing filtrate concentration level (i.e., the volume fraction of filtrate in the live fluid drawn from the formation) and corresponding predicted sensor measurements (such as predicted OD and other predicted sensor measurements such as mass density, shrinkage factor b and GOR-related $f$-function) as a function of cleanup volume and corresponding cleanup time in block 209. In embodiments, the output data of block 209 can include parametric equations or curves that represent the functional relationship between the filtrate concentration level and cleanup volume and the functional relationship between one or more predicted fluid sensor measurements (such as OD and other fluid sensor measurements such as mass density, shrinkage factor b and GOR-related $f$-function) as a function of cleanup volume. The cleanup volume dimension of these functional relationships can be equated to a cleanup time dimension by a scaling factor based on the constant target flow rate, i.e., cleanup time=cleanup volume (1/constant target flow rate). Note that the proxy model can predict the OD sensor measurement using the OD endpoints that are specified as part of the input vector in conjunction with Eqn. 1. Similarly, the proxy model can predict the fluid sensor measurements for mass density, shrinkage factor b and GOR-related $f$-function using the corresponding fluid measurement endpoints that are specified as part of the input vector in conjunction with Eqn. 3, 4 and 5, respectively.

In block 211, one or more fluid sensors that are part of the downhole tool perform measurements of the live formation fluid drawn into the tool over the interval of the cleanup volume (or over the corresponding time interval of cleanup time). Such fluid sensor measurements are referred to herein as observed sensor measurements. The observed sensor measurements can be measurements of OD, mass density, shrinkage factor b, GOR-related $f$-function or some other live fluid measurement(s). The observed sensor measurements can be made on the fluid flow through one or more flow lines of the downhole tool, such as the flow through a sample line, a guard line, a comingled line or any combination of one or more of these lines as part of a focused-sampling downhole tool. The observed sensor measurements are collected and stored over the interval of the cleanup volume (and over the corresponding time interval of cleanup time) for processing in block 213.

In block 213, the observed sensor measurements over the interval of cleanup volume (and corresponding cleanup time) and the corresponding predicted sensor measurements that are part of the output data of block 209 are processed to evaluate an objective function. The objective function is configured to quantify the difference between the observed sensor measurements and the corresponding predicted sensor measurements over the interval of cleanup volume (and corresponding cleanup time) and to identify if such difference has been minimized and satisfies a predefined stopping criterion.

In one example, the objective function of block 213 can be represented as follows:

$$\min_x \int_V W(V)|\widehat{OD} - OD(x)|dV, \tag{8}$$

where $\widehat{OD}$ is an observed optical density, OD(x) is a predicted optical density output by the proxy model, W(V) is a weight-vector, and x is a vector of input parameters including the set of input parameter values and optical density endpoints for the live fluid and a pure filtrate.

Note that since cleanup volume is insensitive to formation mobility, $k_h$ is not included in the objective function of Eqn. (8).

In another example, the objective function of block 213 can be represented as follows:

$$\min_x \int_V \{W_{OD}(V)|\widehat{OD} - OD(x)| + W_{GOR}(V)|\hat{f} - f(x)| + W_b(V)|\hat{b} - b(x)| + W_\rho(V)|\hat{\rho} - \rho(x)|\}dV, \tag{9}$$

where $\widehat{OD}$ is an observed optical density, OD(x) is a predicted optical density output by the proxy model, $\hat{f}$ is an observed GOR-related $f$-function, $f(x)$ is a predicted GOR-related f-function output by the proxy model, $\hat{b}$ is an observed shrinkage factor, b(x) is a predicted shrinkage factor output by the proxy model, $\hat{\rho}$ is an observed mass density, $\rho(x)$ is a predicted mass density output by the proxy model, $W_{OD}(V)$, $W_{COR}(V)$, and $W_\rho(V)$ are weight vectors, and x is a vector of input parameters including optical density endpoints for the live fluid and a pure filtrate and one or more other input parameters.

Note that the predictions for $f(x)$, b(x), and $\rho(x)$ can be computed by the proxy model based on Eqns. 3, 4, and 5 and respectively. Note that mismatch for each measurement contributes to the objective function according to individual weight-vectors.

In block 215, the evaluation of the objective function is checked to determine if the stopping criterion of the objective function has been satisfied. If not, the operations continue to block 217.

In block 217, the value(s) for one or more parameters of the input vector is (are) adjusted and the operations continue for another iteration of the inversion of blocks 205-215. In block 217, the OD endpoint for the virgin fluid and the OD endpoint for pure filtrate can be varied (adjusted) over one or more iterations of the inversion process. The inversion process continues until the stopping criterion of the objective function has been satisfied and the operations continue to block 219.

In block 219, the downhole tool stores and possibly outputs the values of the parameters of the input vector (including the OD endpoint for the virgin fluid and the OD endpoint for pure filtrate) as solved by the proxy model inversion.

Note that the parameter values of the input vector that are solved by the inversion process and stored in block 219 can be displayed as part of a log or other output to a user for reservoir understanding. Such parameter values can also be used for reservoir optimization. For example, such parameter values can be used to decide how best to drill a well, complete a well or develop a field.

In another embodiment, for the case where current contamination monitoring algorithms are assumed to be valid and applicable and the measurement sensor endpoints for the virgin formation fluid and for the filtrate are known, the filtrate contamination concentration curve can be computed explicitly by rearranging Eqn. 1 as follows:

$$\eta = \frac{OD_o - OD_\lambda}{OD_o - OD_f} = \frac{f_o - f}{f_o - f_f} = \frac{b_o - b}{b_o - b_f} = \frac{\rho_o - \rho}{\rho_o - \rho_f} \tag{10}$$

A subsequent inversion process can then be performed using an appropriate proxy model to solve for the formation rock properties and the formation fluid properties listed in Eqn. 6. Furthermore, global sensitivity analysis can be performed prior to this step to guide the inversion process by identifying parameters contributing the most to the variance of the contamination at various stages of the cleanup process as described in U.S. Patent Publ. No. 2016/0216404. Details of the sensitivity analysis can be found in Saltelli et al., "Global Sensitivity Analysis: The Primer," Wiley-Interscience, 2008.

Furthermore, the workflow depicted in FIG. 2 can be used for autonomous operation of the downhole fluid sampling process, wherein the inversion results are constantly updated during the sampling and the current estimate of fluid contamination is computed with associated confidence intervals. Additionally, inversion results can be used to update predicted time or pumpout volume required to reach target level on fluid contamination. Eventually, when the estimated contamination level reaches the pre-defined target level, fluid collection process is initiated. Therefore, the entire process can be made autonomous with no input needed from the operator during the job.

ILLUSTRATIVE EXAMPLES

To test the robustness of the disclosed proxy model inversion process of FIG. 2, two synthetic sampling cases are considered for a three-dimensional radial probe and a focused probe, respectively.

Example 1: 3D Radial Probe in a Thin Formation

We first consider fluid sampling by the 3D radial probe in a thin formation. The "true" contamination and OD color channel responses are computed using the model parameters in Table 1 below and the cleanup proxy model described above. The synthetic OD measurements are then generated by adding 1% relative noise to the OD. For each of 50 realizations of the noise, the model is inverted for the parameters in Table 1.

FIGS. 3A-3F show results of the 50 inversions using OD measurements until V=344 L, at which point the true contamination is 2%. All inversion results fit the true OD measurements closely, and inversion in noise-free data recovers the true contamination response and formation and fluid parameters (see Table 1). The parameter estimates reveal correlations among some of the parameters, notably between porosity and filtrate invasion depth which both govern cleanup volume. The mean contamination estimate at V=344 L is 2.2% with a P10-P90 range of 1.6%-2.9%. Note that the proximity of the tool to bed boundaries affects the late-time cleanup, and the contamination curve therefore deviates from fixed-exponent power-law behavior.

TABLE 1

True parameter values, parameter inversion bounds, and final estimates for the synthetic OCM inversionproblem for 3D radial probe sampling. Additional model settings used: $k_h$ = 10 md, $\mu_f$ = 1 cP, $D_w$ = 21.59 cm (8.5 in), z = 0.5, Q = 25 $cm^3$/s.

| | $k_v/k_h$ | Hm | $\mu_o$ cP | $R_{inv}$ cm (in) | $\phi$ | $OD_o$ |
|---|---|---|---|---|---|---|
| True | 1.0 | 1.5 | 2.0 | 17.8 (7) | 0.18 | 1.7 |
| Min | 0.1 | 1.0 | 0.5 | 7.6 (3) | 0.10 | 1.2 |
| Max | 2.0 | 5.0 | 4.0 | 30.5 (12) | 0.25 | 2.2 |
| Inverted (noise-free) | 1.0 | 1.5 | 2.0 | 17.8 (7) | 0.18 | 1.7 |
| Inverted (mean over 50 realizations) | 1.0 | 1.6 | 2.0 | 18.5 (7.3) | 0.16 | 1.7 |

Figure 4A:
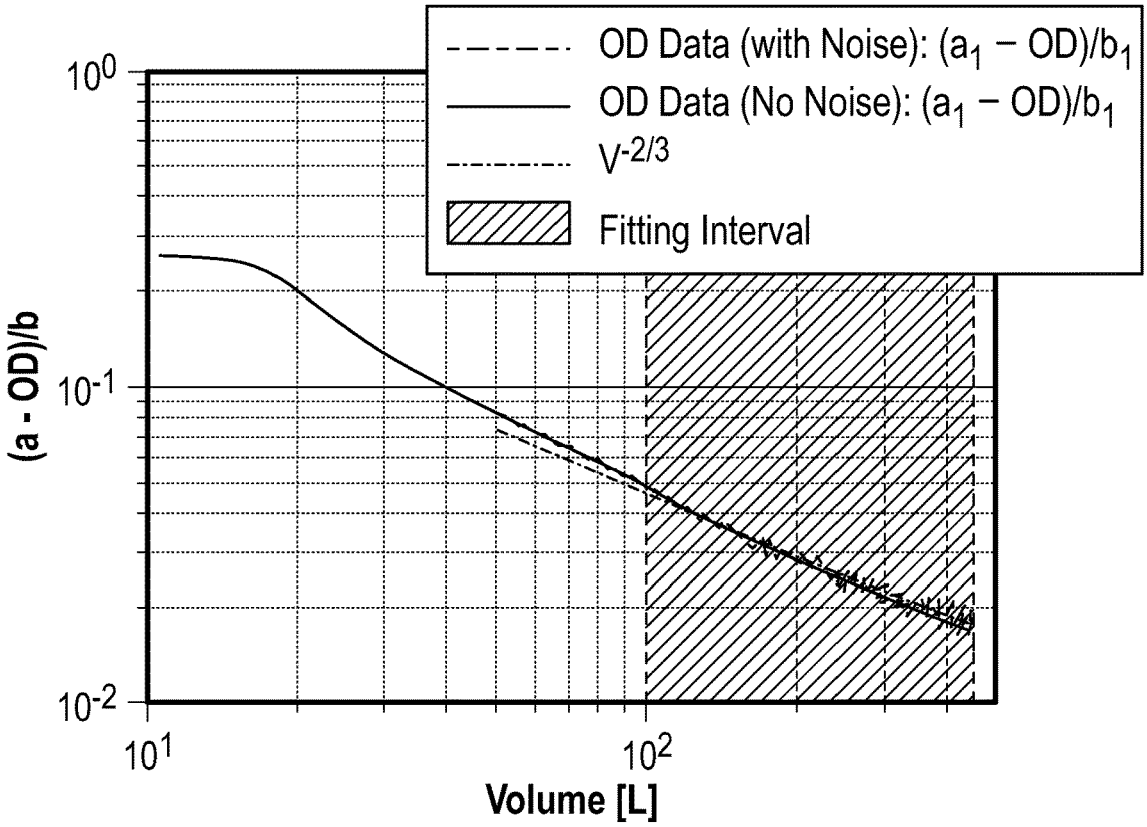
FIGS. 4A-4D depict the results of a conventional OCM workflow as applied to single-channel synthetic OD data for the cleanout operations of a fluid sampling process carried out by a three-dimensional radial probe. The optical density endpoint of the virgin oil $OD_o$ is obtained by fitting the power-law model (Eq. 2) to the observed OD data within a fitting interval determined from the flow regime where the data obeys a constant-exponent power-law.
Figure 4B:
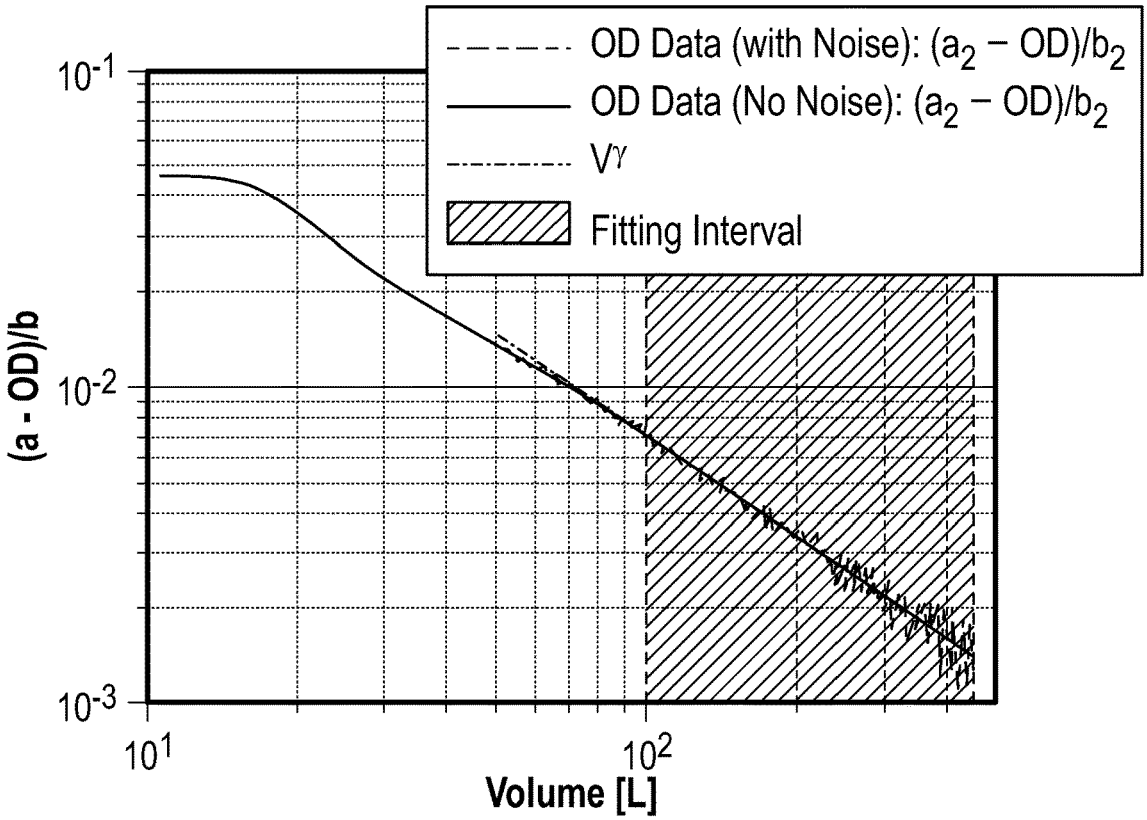
Figure 4C:
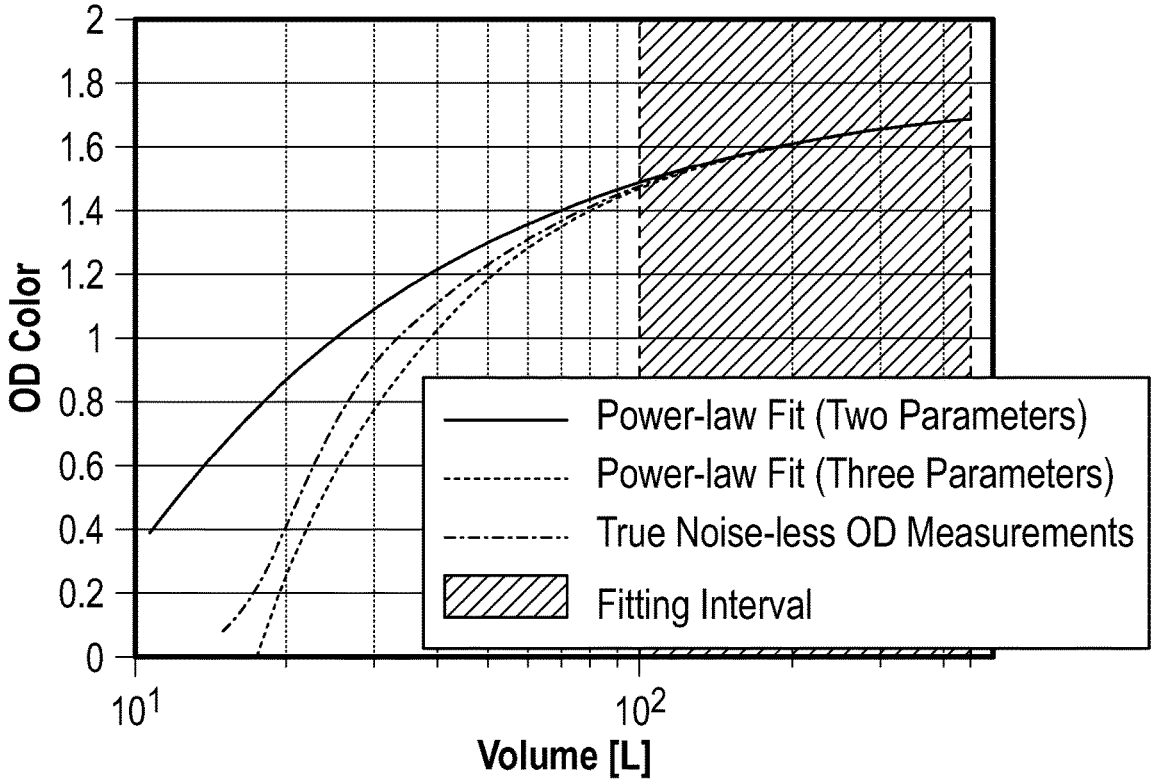
Figure 4D:
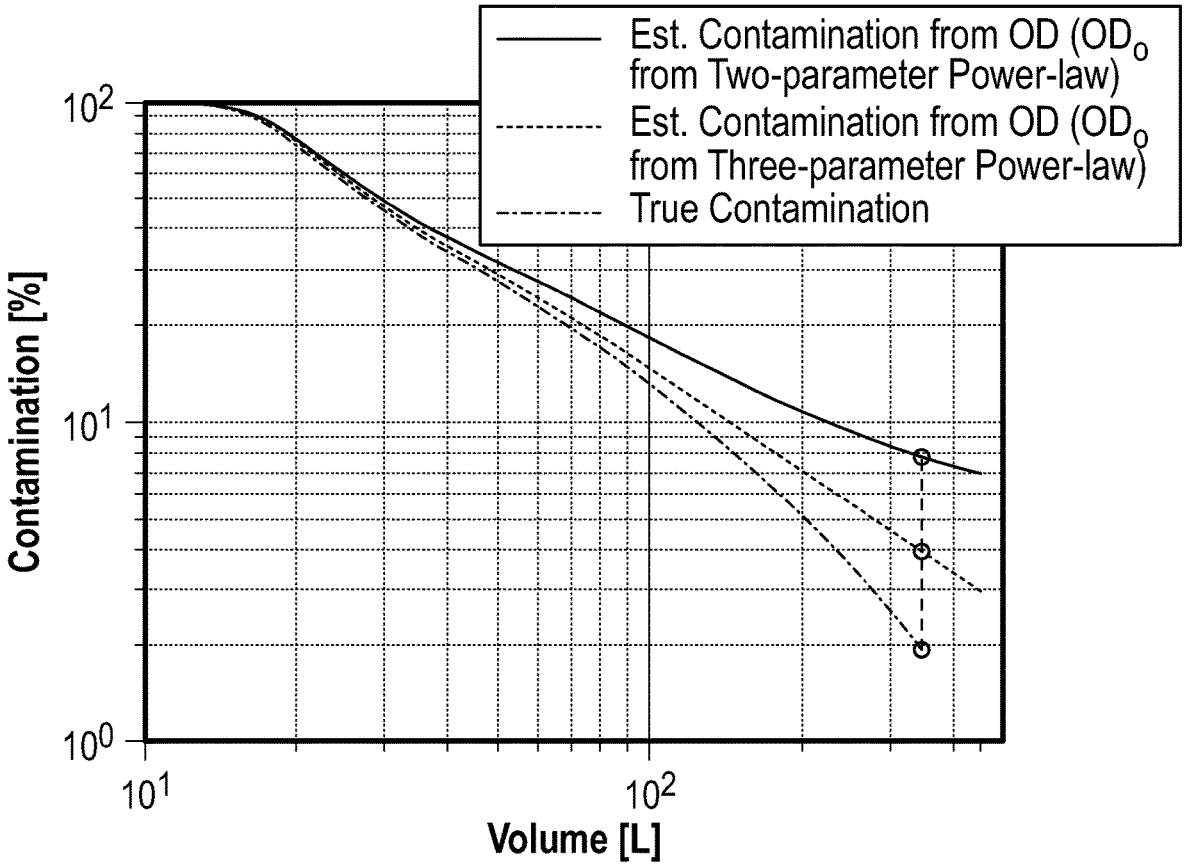
Figure 5A:
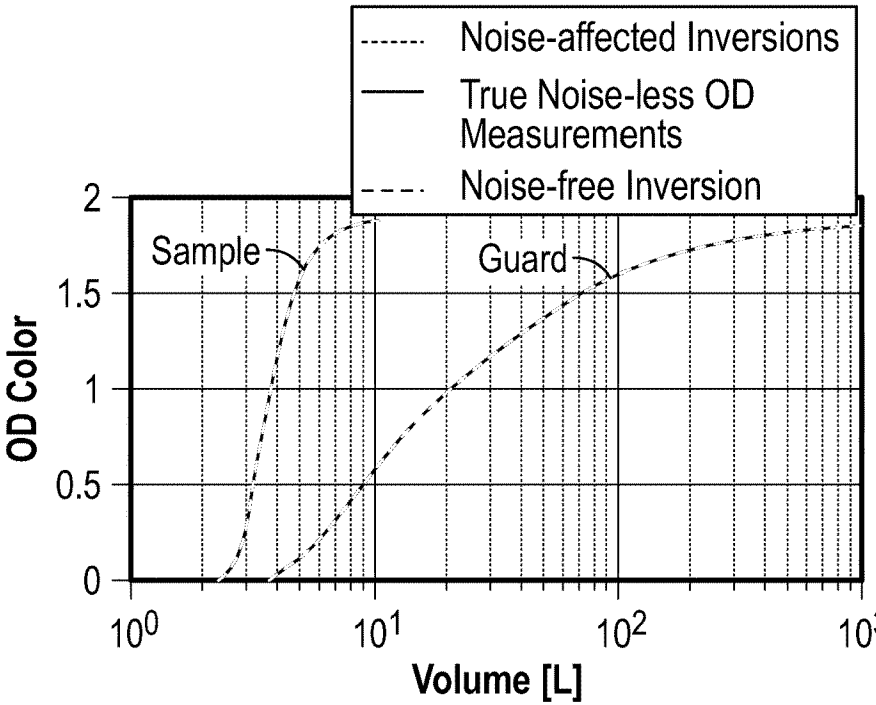
FIGS. 5A-5F depict inversion results for proxy model inversion processing similar to FIG. 2 and applied to synthetic data for the cleanout operations of a fluid sampling process carried out by a downhole tool with focused sampling hardware. The inversions of the proxy model are based on the synthetic OD measurements and predicted OD measurements for both the sample line and the guard line. The synthetic OD measurements are generated for both sample and guard lines by adding 3% relative noise to the synthetic OD data.
Figure 5B:
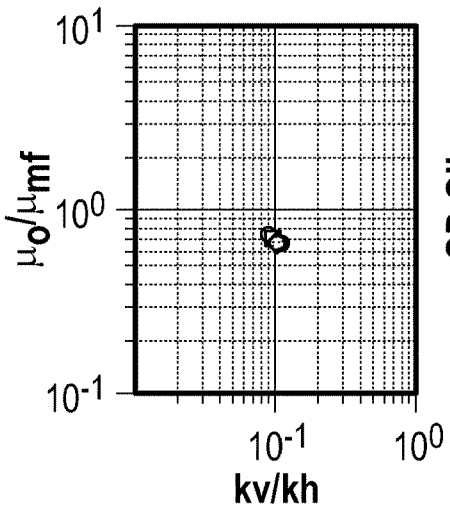
Figure 5C:
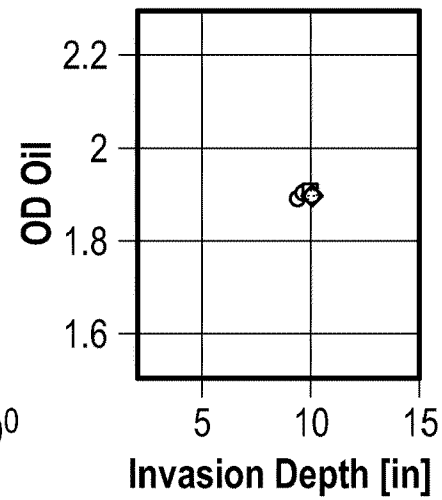
Figure 5D:
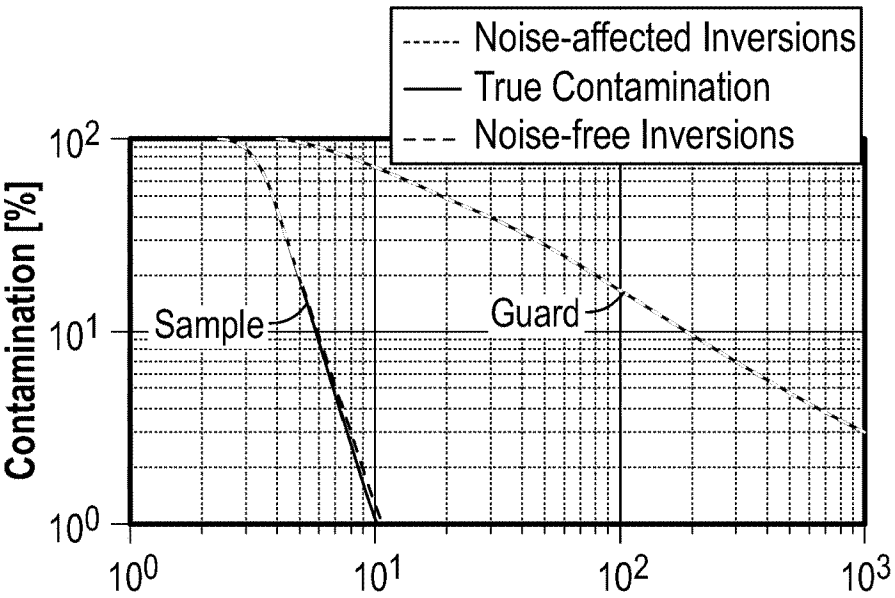
Figure 5E:
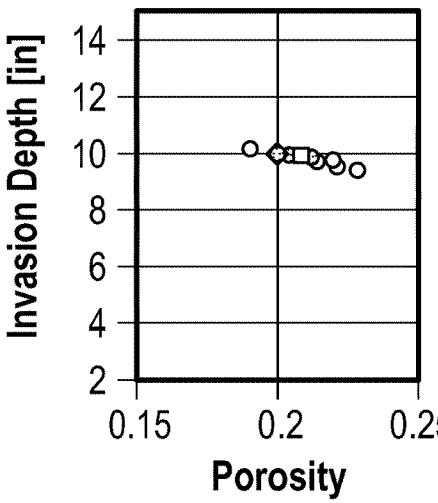
Figure 5F:
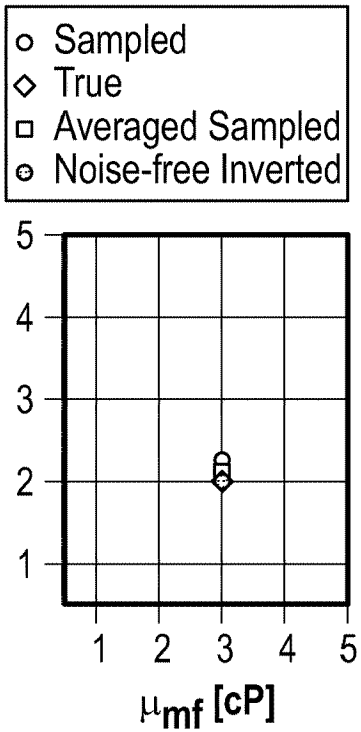
Figure 5G:
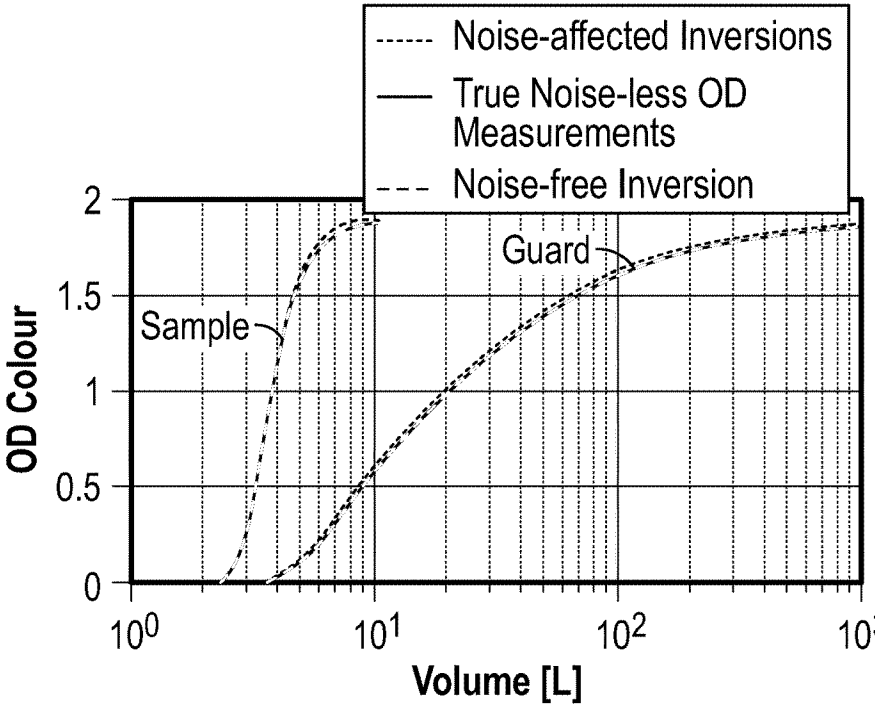
FIGS. 5G-5L depict inversion results for proxy model inversion processing similar to FIG. 2 and applied to synthetic data for the cleanout operations of a fluid sampling process carried out by a downhole tool with focused sampling hardware. The inversions of the proxy model are based on the synthetic OD measurements and predicted OD measurements for the sample line only. The synthetic OD measurements are generated for both sample and guard lines by adding 3% relative noise to the synthetic OD data.
Figure 5H:
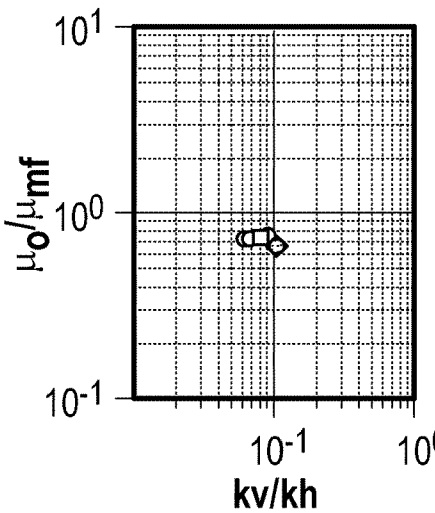
Figure 5I:
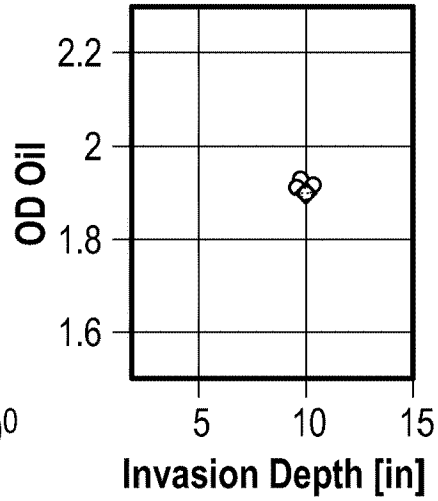
Figure 5J:
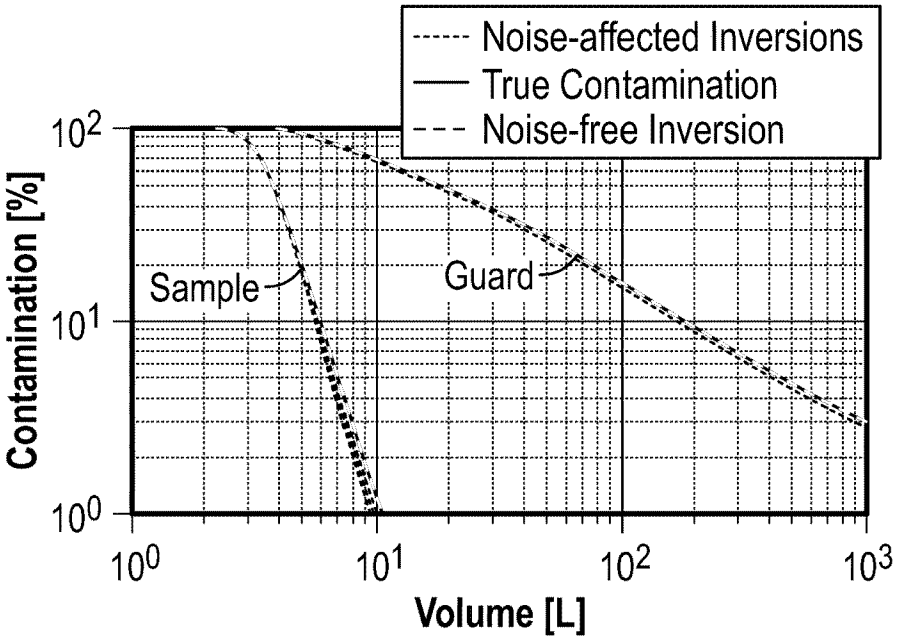
Figure 5K:
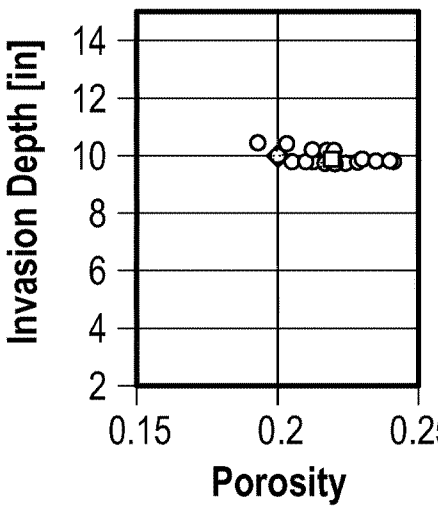
Figure 5L:
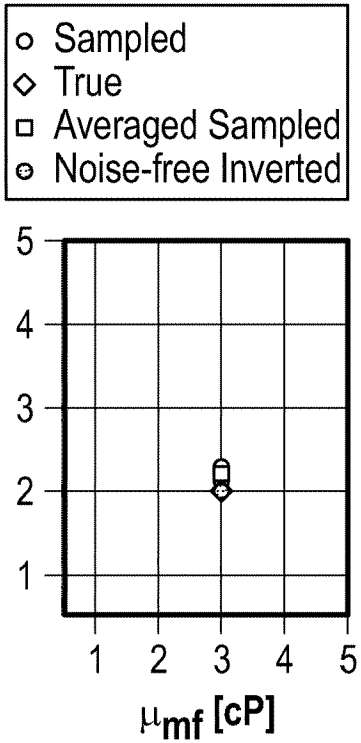
Figures 6A, 6B, 6C, 6D:
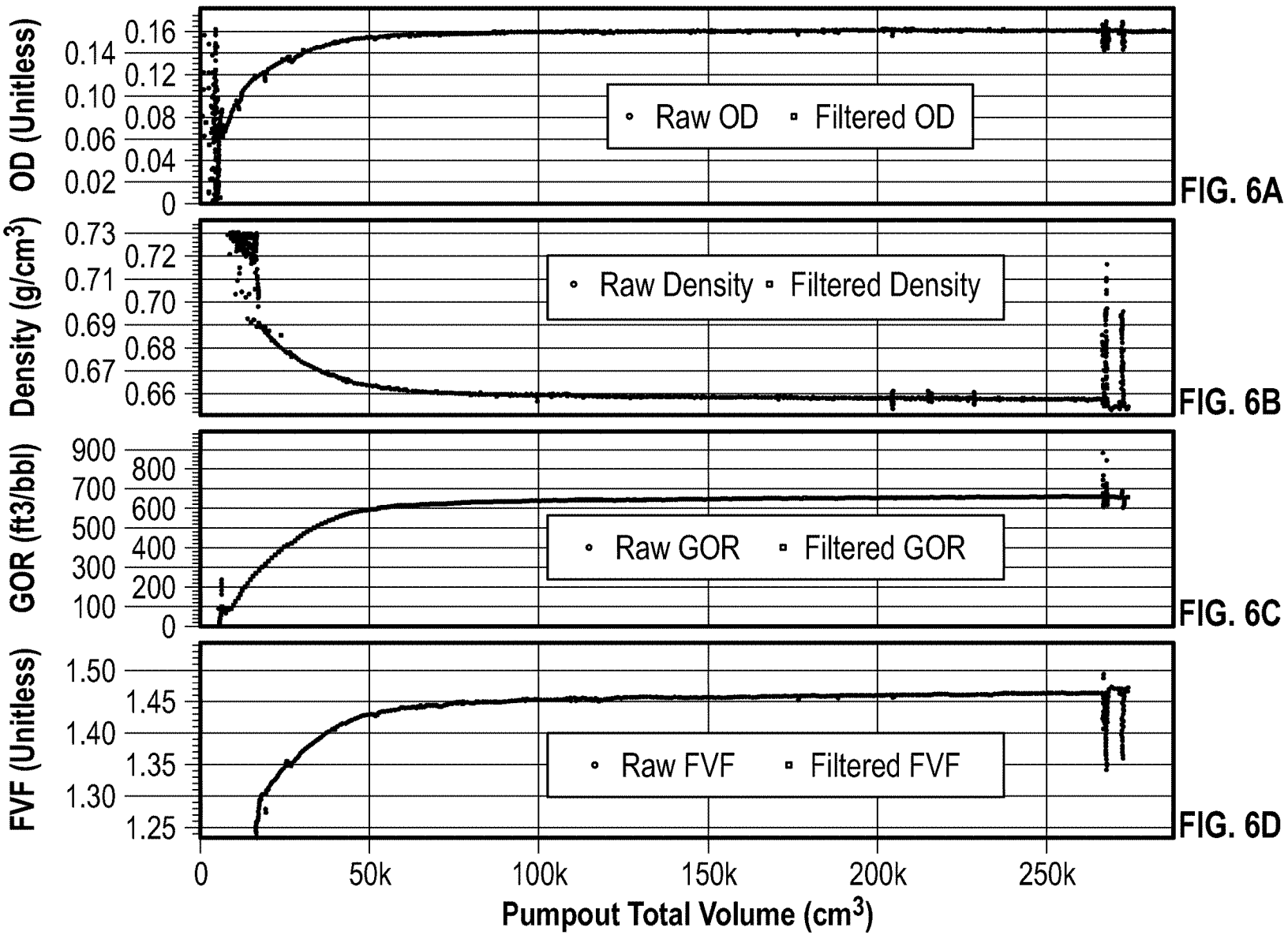
FIGS. 6A-6D depicts multiple sensor measurements as a function of cleanup volume during cleanup of a sampling process carried out by a downhole tool with a three-dimensional radial probe.

To contrast the disclosed proxy model inversion process with conventional power-law-based approaches, we illustrate the conventional power-law-based approaches in FIGS. 4A-4D. Given OD measurements, the conventional power-law-based approach proceeds by rearranging Eq. 2 and plotting (a OD)/b vs. V on a log-scale as shown in FIGS. 4A and 4B to identify a regime of constant-exponent power-law behavior. The power-law model is then fitted to the OD measurements as shown in FIG. 4C and extrapolated to infinite volume as shown in FIG. 4D to obtain the OD endpoint of formation fluid. Finally, contamination estimates are computed from the endpoints and measured OD using Eqn. 1.

Theoretically, the late-time cleanup behavior for the three-dimensional radial probe follows $\gamma$=2/3 in Eq. 2 (Hammond, 1991; and Kristensen et al., "Flow modeling and comparative analysis for a new generation of wireline formation tester modules," IPTC 17385: Presented at the International Petroleum Technology Conference, Doha, Qatar, Jan. 20-22, 2014). Hence, this value is typically used for radial probe OCM. A likely interpretation of the flow regime plot (FIG. 4A) would be that late-time OD data obeys this exponent, especially when accounting for the noise in the data. When fitted within the interval indicated, the power-law model gives an OD endpoint of 1.81, which leads to a contamination estimate of 8% at V=344 L, compared to the true contamination of 2%. Including the exponent when fitting the power-law leads to the results shown in FIG. 4B and a contamination estimate of 4%. As this example illustrates, flow regime identification is not straightforward and interpretation using a constant-exponent power-law model may bias the contamination estimates when the underlying cleanup process deviates from the assumed behavior. Moreover, closely matching OD measurements and power-law predictions (FIG. 4C) may lead to a false sense of accuracy in the contamination predictions.

Example 2: Focused Probe Sampling

In a second synthetic example, we consider OCM for the cleanup operations of a fluid sampling process of downhole tool that employs focused sampling hardware that includes a sample line and guard line (e.g., FIGS. 11, 12, 13, 14A, 14B). As in the first example, the contamination and OD color channel responses are computing using the model parameters in Table 2 and the proxy model described earlier. Synthetic OD measurements is generated for both sample and guard lines by adding 3% relative noise to the synthetic OD data. For each of 50 realizations of the noisy synthetic OD data, the proxy model is then inverted for the parameters in Table 2. We consider two scenarios: (1) inversion of the proxy model based on the synthetic OD measurements and predicted OD measurements for the sample line only, and (2) inversion of the proxy model based on the synthetic OD measurements and predicted OD measurements for both the sample line and the guard line.

TABLE 2

True parameter values, parameter inversion bounds, and final estimates for the synthetic OCM inversion problem for focused probe sampling. Additional model settings used: $k_h$ = 100 md, $\mu_f$ = 3 cP, $D_w$ = 21.59 cm (8.5 in), H = 50 m, z = 0.5, Q = 10 $cm^3$/s. S = sample line, G = guard line.

| | $k_v/k_h$ | $\mu_o$ cP | $R_{inv}$ cm (in) | $\phi$ | $OD_o$ |
|---|---|---|---|---|---|
| True | 0.10 | 2.0 | 25.4 (10) | 0.20 | 1.90 |
| Min | 0.01 | 0.5 | 5.1 (2) | 0.15 | 1.50 |
| Max | 1.00 | 5.0 | 38.1 (15) | 0.25 | 2.30 |
| Inverted: S + G (noise-free) | 0.10 | 2.0 | 25.4 (10) | 0.20 | 1.90 |
| Inverted: S + G (mean over 50 realizations) | 0.09 | 2.1 | 24.9 (9.8) | 0.21 | 1.90 |
| Inverted: S only (noise-free) | 0.10 | 2.0 | 25.4 (10) | 0.20 | 1.90 |
| Inverted: S only (mean over 50 realizations) | 0.08 | 2.2 | 24.9 (9.8) | 0.22 | 1.92 |

FIGS. 5A-5F show results from the 50 inversions of the proxy model based on the synthetic OD measurements and predicted OD measurements for both the sample line and the guard line. FIGS. 5G-5L show results from the 50 inversions of the proxy model based on the synthetic OD measurements and predicted OD measurements for the sample line only. In both cases, inversion in noise-free data recovers the true contamination response and formation and fluid properties (see Table 2). Similar to three-dimensional radial probe example described above, the parameter estimates indicate correlation between filtrate invasion depth and porosity, but in general the estimates appear robust to measurement noise. The estimated contamination at V=8.7 L, at which point the true sample line contamination reaches 2%, varies between 1.6% and 2.0%. Ignoring guard line data in the inversions has only a minor impact on the accuracy of the contamination and parameter estimates, as shown in Table 2. While guard line data can help to constrain the inversion problem, the dynamic range from such data in real sampling jobs is naturally limited by the termination of the sampling job when the sampling line contamination reaches below the desired threshold. Thus, robustness of the OCM algorithm is important when limited guard line data is available. However, it is still recommended to include all available data (sample+guard) in the inversion.

Field Example

Below we provide an illustrative example of applying the proxy model inversion operations to real field data obtained during three-dimensional radial probe sampling. While multi-sensor measurements were obtained in this sampling job as shown in FIGS. 6A-6D, we will focus only on OD data of FIG. 6A for simplicity. Due to low filtrate-to-formation fluid contrast, no color channel can be used for interpretation in this case.

Therefore, for contamination analysis from OD only, the methane channel is selected (channel 11: 1671 nm wavelength), with baseline channel 9 (1600 nm wavelength). This adds two extra parameters corresponding to the OD endpoints for the filtrate and virgin formation fluid to the list of invertible parameters shown in Table 3. The bounds for the parameters were established based on available petrophysical data.

TABLE 3

Parameter bounds, initial parameter guesses, and final estimates for the field data inversion problem.

| | $k_v/k_h$ | $\mu_o/\mu_{mf}$ | $R_{inv}$ cm (in) | $\phi$ | $OD_{mf}$ | $OD_o$ |
|---|---|---|---|---|---|---|
| Min | 0.01 | 0.25 | 7.6 (3) | 0.120 | 0.01 | 0.160 |
| Max | 1 | 2.00 | 30.5 (12) | 0.170 | 0.07 | 0.170 |
| Initial | 0.1 | 0.73 | 19.1 (7.5) | 0.145 | 0.04 | 0.164 |
| Inverted | 0.15 | 0.44 | 18.1 (7.1) | 0.167 | 0.06 | 0.165 |

Results of the proxy-model inversions as compared to predictions based on fixed-exponent power law are shown in FIGS. 7A, 7B, 8A and 8B. A simple weight-vector, W(V)=V, was used in the objective function of Eqn. 8 to enforce a good fit with the measured data for the low-contamination stage of the cleanup process. Overall, the results of the inversion of the proxy model agree well with power-law interpretation for the late-time period (when power-law cleanup regime is valid), while also providing a reasonably close estimate for the breakthrough time. The mismatch in early stages of cleanup is amplified by the log scale in FIG. 7B. Predicted late-time contamination levels were also confirmed by the lab measurements. Contamination levels of 2.7% (volumetric fraction of contamination) was measured in the lab, compared to 2.6% estimated by the traditional OCM algorithm, and 3.1% estimated by the inversion of the proxy model In general, values of inverted parameters are consistent with available petrophysical data, pretest mobility estimates, and endpoint estimates obtained from current OCM interpretation ($OD_o$=0.1644 and $OD_f$=0.0641). We have super-imposed a uniformly distributed noise with maximum amplitude of 3% on the measured OD and performed inversion for 200 random realizations of the noise.

Figure 7A:
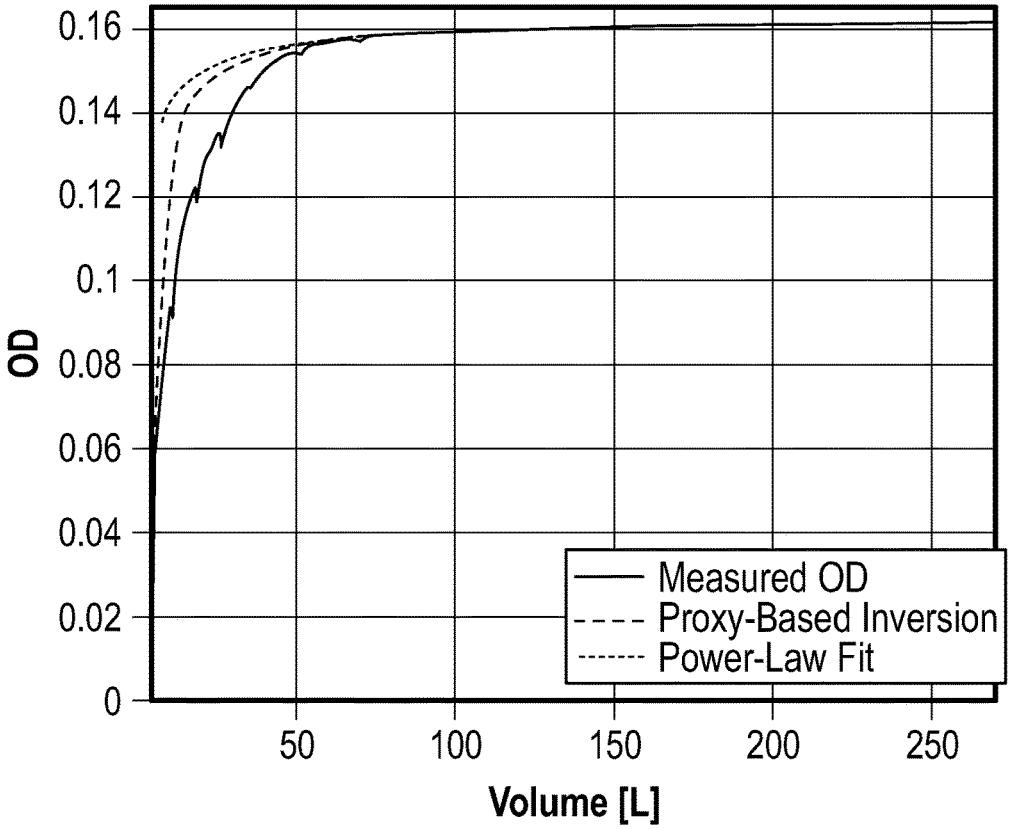
FIG. 7A shows the results of proxy model inversion processing similar to FIG. 2 applied to the sensor measurements of FIG. 6A (labeled "Measured OD") as well as the results of the fixed exponent power-law fit for OD.
Figure 7B:
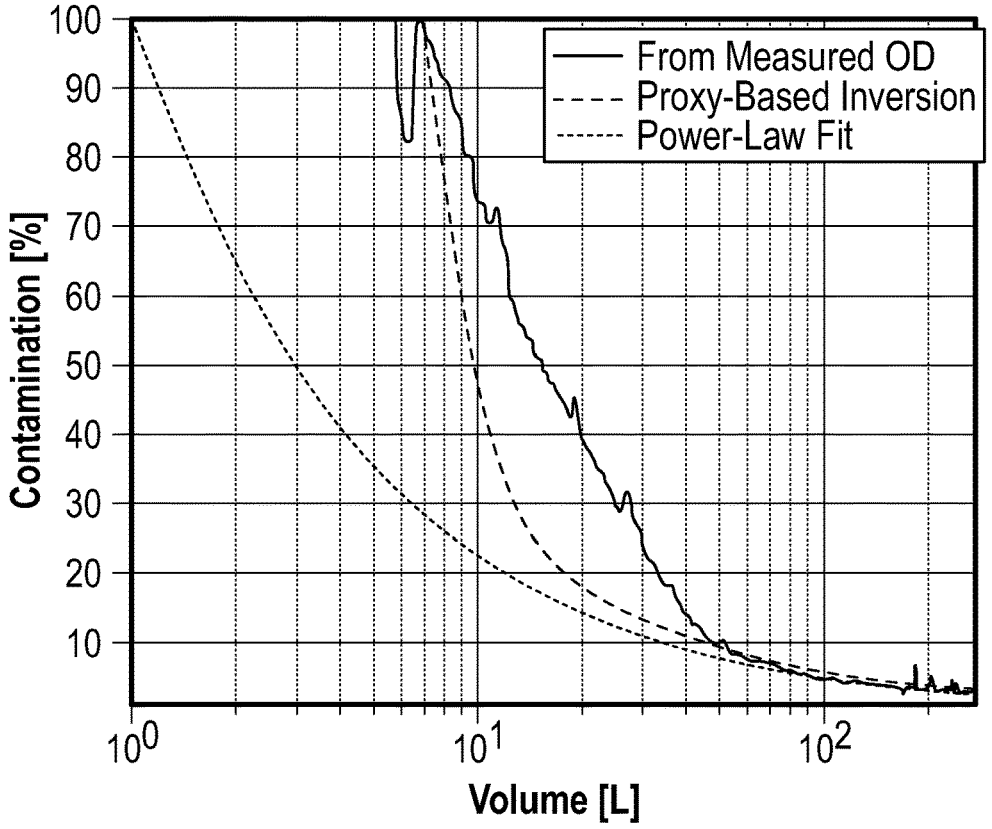
FIG. 7B shows the results of the proxy model inversion processing of FIG. 7A in comparison to measured contamination and the fixed exponent power-law fit for contamination. The contamination curve labelled "From measured OD" uses the endpoint OD values from conventional OCM.
Figure 8A:
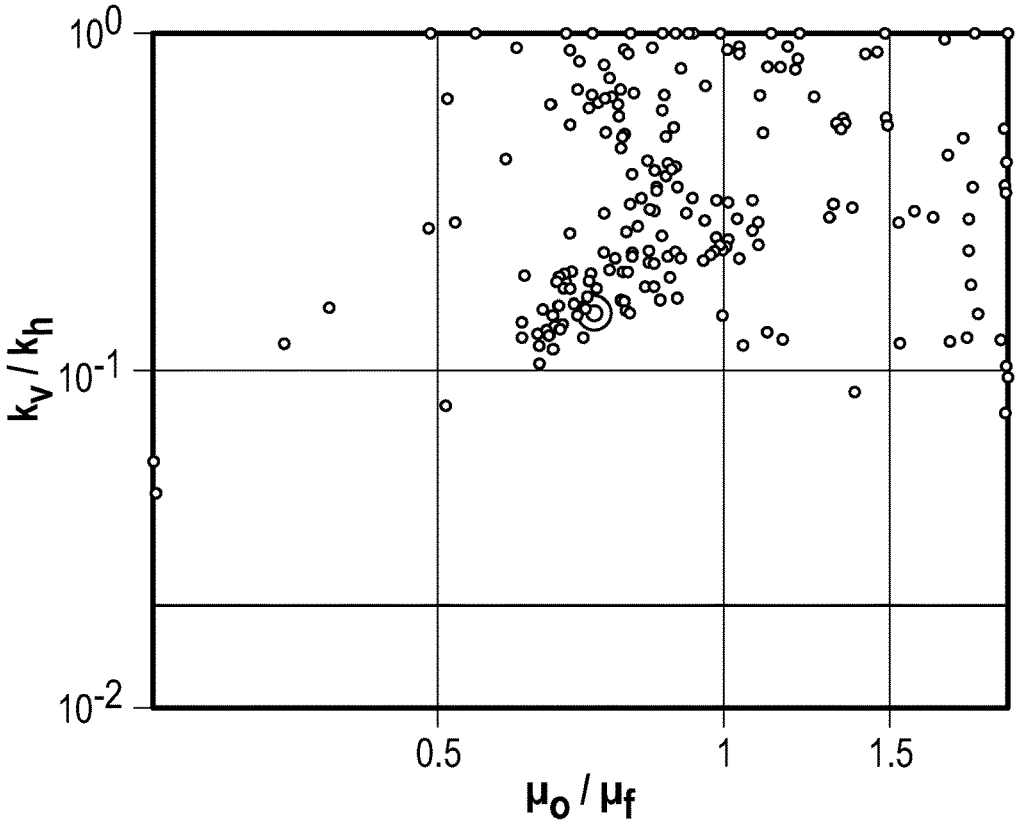
FIGS. 8A-8C depicts the results of the proxy model inversion processing of FIGS. 7A and 7B corresponding to random realizations of super-imposed noise. Hollowed circles indicate results of noiseless inversion corresponding to the results shown in Table 3 and FIGS. 7A and 7B.
Figure 8B:
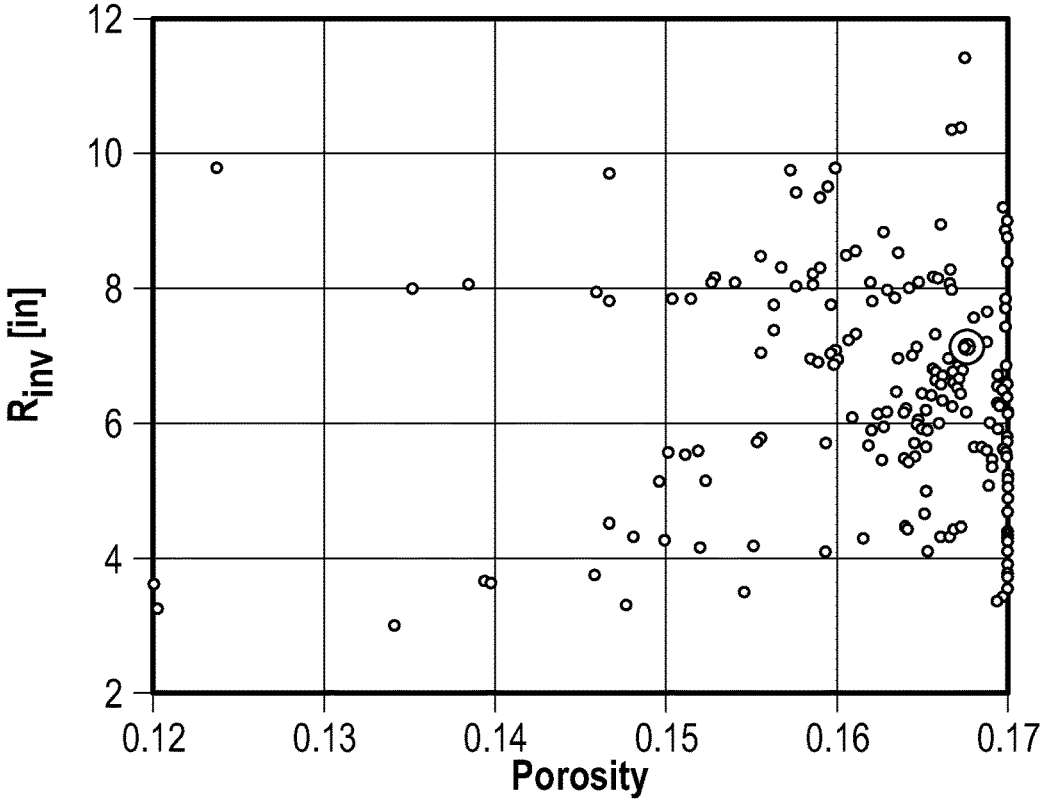
Figure 8C:
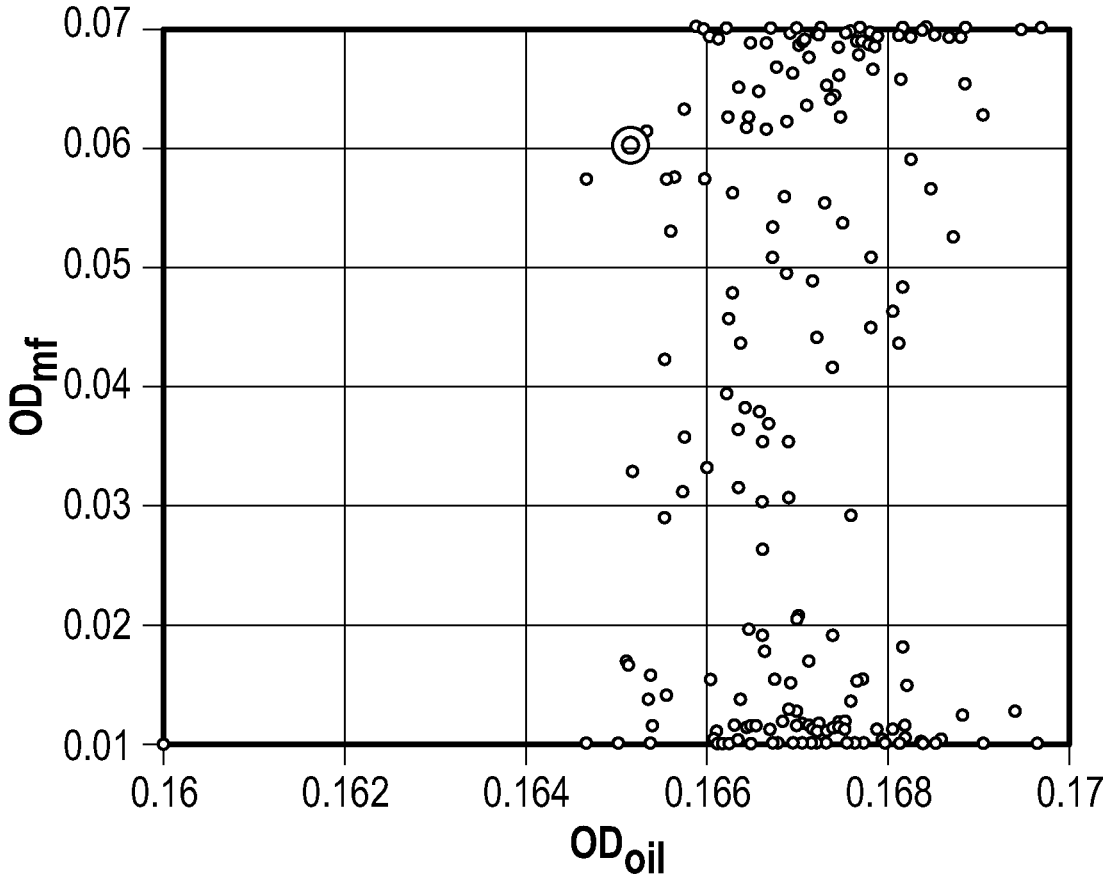

Estimates of the parameters that result from the inversion results of FIGS. 7A and 7B are shown in FIGS. 8A and 8B. The spread of parameter estimates indicates an elevated sensitivity to the noise in OD data, as well as possible non-uniqueness in proxy-based solutions. Among the considered input parameters, $OD_o$ appears to be the most constrained one by the inversion. This is expected, since the selected weight-vector in the objective function enforces the late-time fit, which is largely sensitive to the value of the $OD_o$ endpoint. In the synthetic case studies, we observed negative correlation between depth of invasion and porosity, suggesting their strong link in defining the cleanup volume. However, in the considered field example, this correlation does not seem to be significant.

Proxy-Based Optimization and Control of Downhole Fluid Sampling Using Focused Probes In embodiments, the proxy model as described herein can be used for closed-loop optimal control and adjustment of operational parameters of the downhole tool during the cleanup operations of a reservoir fluid sampling process. In particular, the proxy model can be used to determine optimal flow rates (or pump rates) of the live fluid drawn into the tool, such as optimal flow rates for sample and guard lines that minimize the cleanup time or optimal sample/guard split ratios that minimize the cleanup time.

Figure 9A:
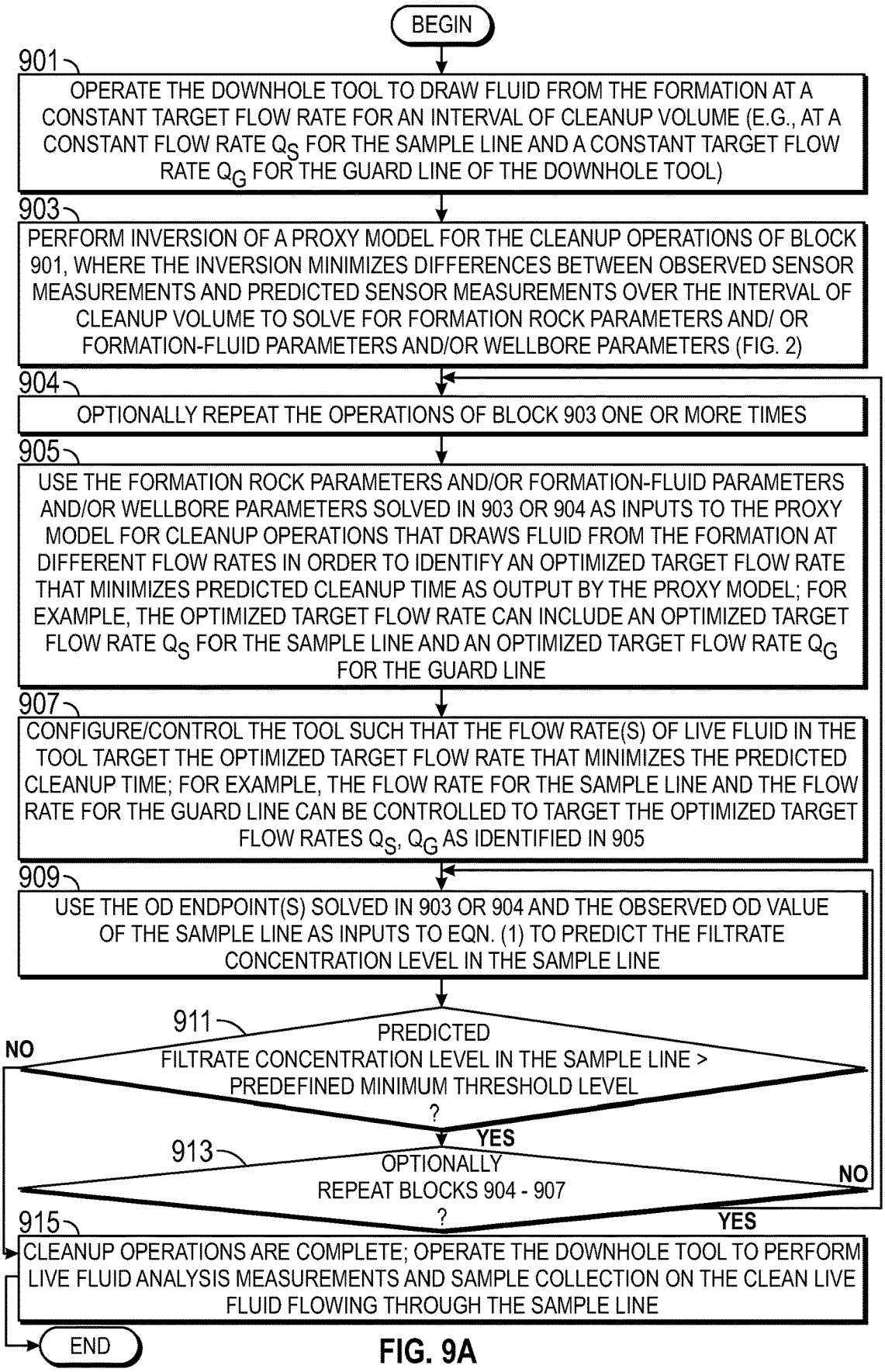
FIG. 9A is a flow chart of an exemplary control process that uses the proxy model for cleanup operations in conjunction with input parameters solved by proxy model inversion to determine an optimal target flow rate (or pump rate) that minimizes the cleanup time for the cleanup operations.

FIG. 9A is a flow chart that illustrates an example control process that uses the proxy model to determine optimal flow rates (or pump rates) for sample and guard lines that minimize the cleanup time. In this process, the downhole tool employs focused sampling hardware with separate guard and sample lines where the guard line acts to shield the flow of mud filtrate to the sample line thus leading to faster cleanup. During such focused sampling, the guard and sample line flow rates (or pump rates) can be manipulated independently, thus allowing for optimization of pump rate profiles to maximize overall sampling efficiency.

In block 901, the downhole tool is operated to draw fluid from the formation at a constant target flow rate (or pump rate) for an interval of cleanup volume. For the example focused sampling hardware, the constant flow rate includes a constant flow rate $Q_s$ for the sample line and a constant target flow rate $Q_g$ for the guard line of the downhole tool.

In block 903, an inversion process is performed using a proxy model for the cleanup operations of block 901. The inversion process minimizes differences between observed sensor measurements and predicted sensor measurements over the interval of cleanup volume to solve for formation rock parameters and/or formation-fluid parameters and/or wellbore parameters which part of the input vector supplied to the proxy model (FIG. 2).

In optional block 904, the inversion process of block 903 can be repeated one or more times. For example, the inversion process can be repeated one or more times during the cleanup operations as more data becomes available, which can used to better constrain the model parameters.

In block 905, the formation rock parameters and/or formation-fluid parameters and/or wellbore parameters solved in block 903 (or 904) are used as inputs to the proxy model for cleanup operations that draws fluid from formation at different flow rates in order to identify an optimized target flow rate that minimizes predicted cleanup time as output by the proxy model. For the example focused sampling hardware, the optimized target flow rate can include an optimized target flow rate $Q_s$ for the sample line and an optimized target flow rate $Q_g$ for the guard line. In block 905, the formation rock parameters and/or formation-fluid parameters and/or wellbore parameters solved in block 903 can be used as inputs to the proxy model for cleanup operations that draws fluid from formation at a set flow rate (which involves a set flow rate $Q_s$ for the sample line and a set flow rate $Q_g$ for the guard line) in order to identify the predicted cleanup volume that will achieve the desired low-level of filtrate contamination. The difference between this cleanup volume and the current cleanup volume provides an estimate for the remaining cleanup volume, which can be mapped to an estimate for the remaining cleanup time based on the set flow rate. This process can be repeated for a number of different set flow rates (different combinations of flow rate $Q_s$ for the sample line and flow rate $Q_g$ for the guard line) that are supported by the proxy model to estimate the remaining cleanup times for the number of different set flow rates. A minimal remaining cleanup time can be identified from the ranked list of the remaining cleanup times for the number of different set flow rates, and the set flow rate (the particular combination of flow rate $Q_s$ for the sample line and flow rate $Q_g$ for the guard line) that contributed to the minimal remaining cleanup time can be selected as the optimized target flow rates at that point in the process.

In block 907, the downhole tool is configured/controlled such that the flow rate(s) of fluid in the tool target the optimized target flow rate that minimizes the predicted cleanup time. For the example focused sampling hardware, the flow rate for the sample line and the flow rate for the guard line can be controlled to target the optimized target flow rates $Q_s$, $Q_g$ as identified in 905. Such control can be accomplished by closed-loop electronic control of various pumps or valves that control the flow rate for the sample line and the flow rate for the guard line.

In block 909, the OD endpoint(s) solved in block 903 (or 904) and the observed OD value of the sample line can be used as inputs to Eqn. (1) to predict the filtrate concentration level in the sample line.

In block 911, the operations check whether the predicted filtrate concentration level in the sample line of block 909 is greater than a predefined minimum threshold level (such as 1 or 2% volume fraction of filtrate in the live fluid). If so, the operations continue to block 913. Otherwise, the operations continue to block 915.

In block 913, the operations of block 904 to 907 can optionally be repeated for one or more times (for example, at a number of set time periods during the cleanup operations or at regular time intervals during the cleanup operations or as more data becomes available during the cleanup operations). Such repeated processing can possibly better optimize the target flow rate that minimizes the predicted cleanup time. If such repeated processing is not carried out, the operations revert to blocks 909 and 911 to continue monitoring the filtrate contamination level in the sample line.

In block 915, the predicted filtrate concentration level in the sample line falls at or below the predefined minimum threshold level, and the cleanup operations are complete. In this case, the downhole tool can be operated to perform live fluid analysis measurements and sample collection on the clean live fluid flowing through the sample line.

Figure 9B:
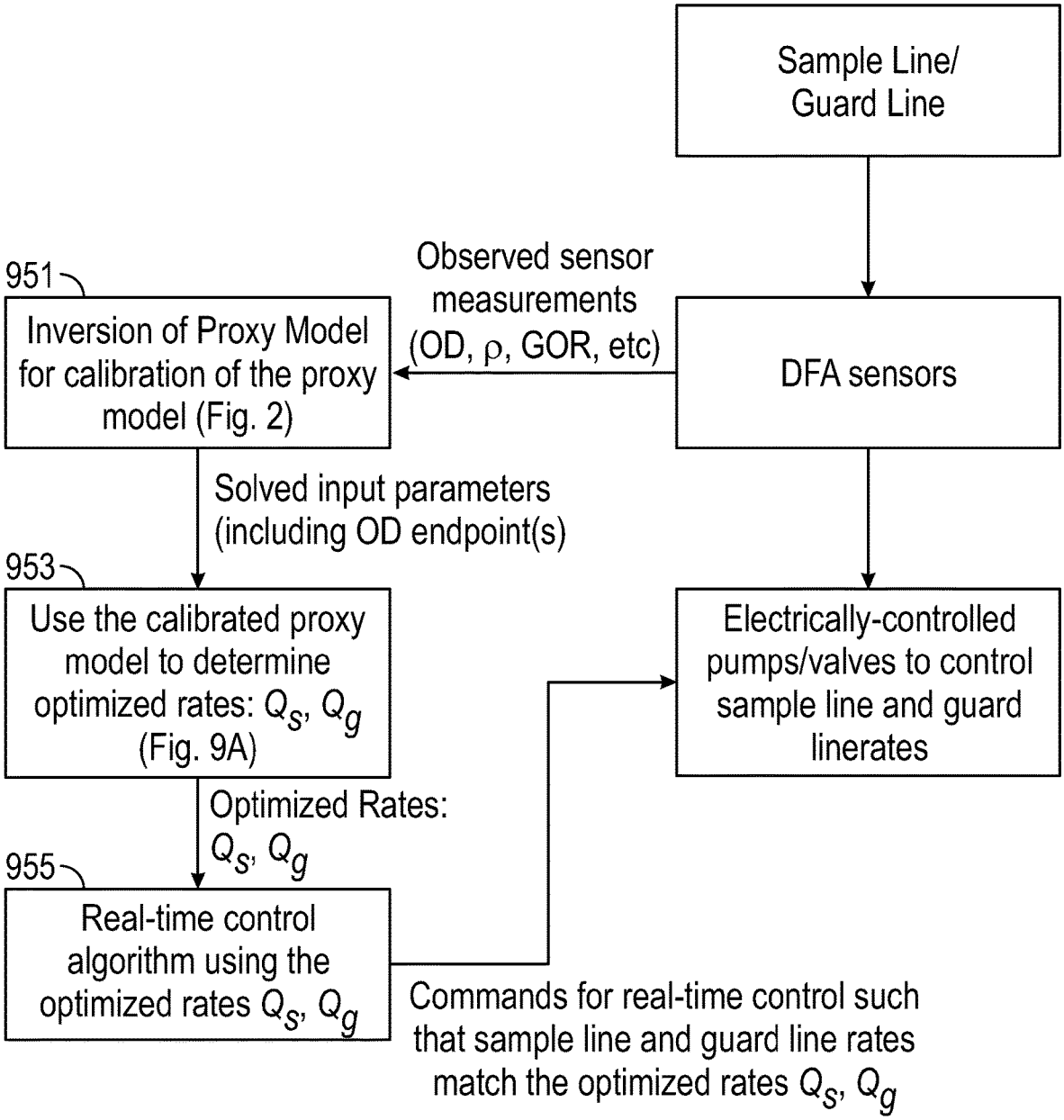
FIG. 9B depicts a schematic representation of closed-loop optimum control for the cleanup operations of a downhole fluid sampling process carried out by a downhole tool with focused sampling hardware, which includes a first part that employs proxy model inversion for calibration of the proxy model and second part that employs the calibrated proxy model to determine optimized rates for the sample line and the guard line of the focused downhole tool.

FIG. 9B illustrates a method for real-time optimum control of the cleanup operations of a downhole fluid sampling process carried out by a downhole tool with focused sampling hardware. In the first part 951 of the process, DFA sensor measurements are used in conjunction with a proxy model of the cleanup operations to predict filtrate contamination levels. This first part performs an inversion of the proxy model that calibrates the proxy model by updating formation and fluid properties (FIG. 2). In the second part 953 of the process, the calibrated proxy model is used for forward predictions and to determine optimized rates $Q_s$, $Q_g$ for the sample line and guard line, respectively, of the downhole tool. The optimized rates $Q_s$, $Q_g$ optimize the sampling objective, which is minimizing the remaining cleanup time required to reach a predetermined threshold contamination level (FIG. 9A). In the third part 955 of the process, real-time control of the pumps and/or valves of the downhole tool is carried out such that the flow rate of fluid drawn through the sample line and the guard line match the optimized rates $Q_s$, $Q_g$, respectively.

Figure 10A:
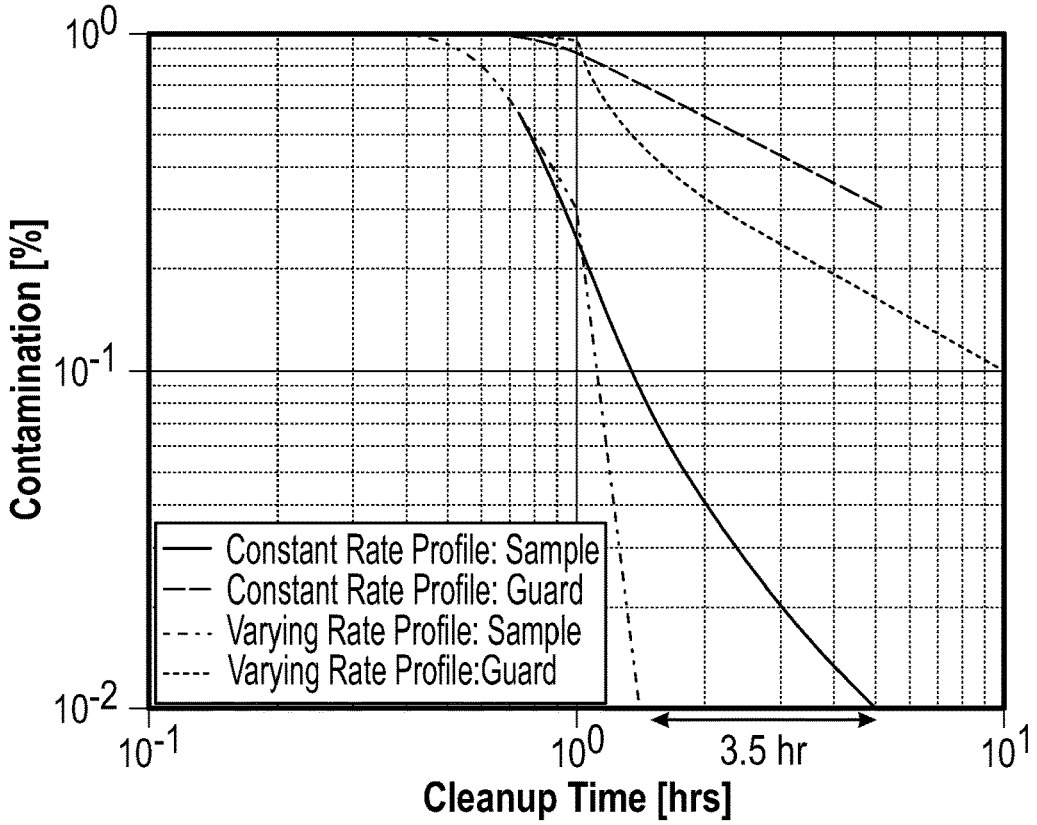
FIGS. 10A and 10B are plots that depict a comparison of cleanup efficiency for two pumping rate profiles for a focused downhole sampling tool. Significant time-savings are possible by optimizing the pump rate profiles using the control process of FIGS. 9A and 9B.
Figure 10B:
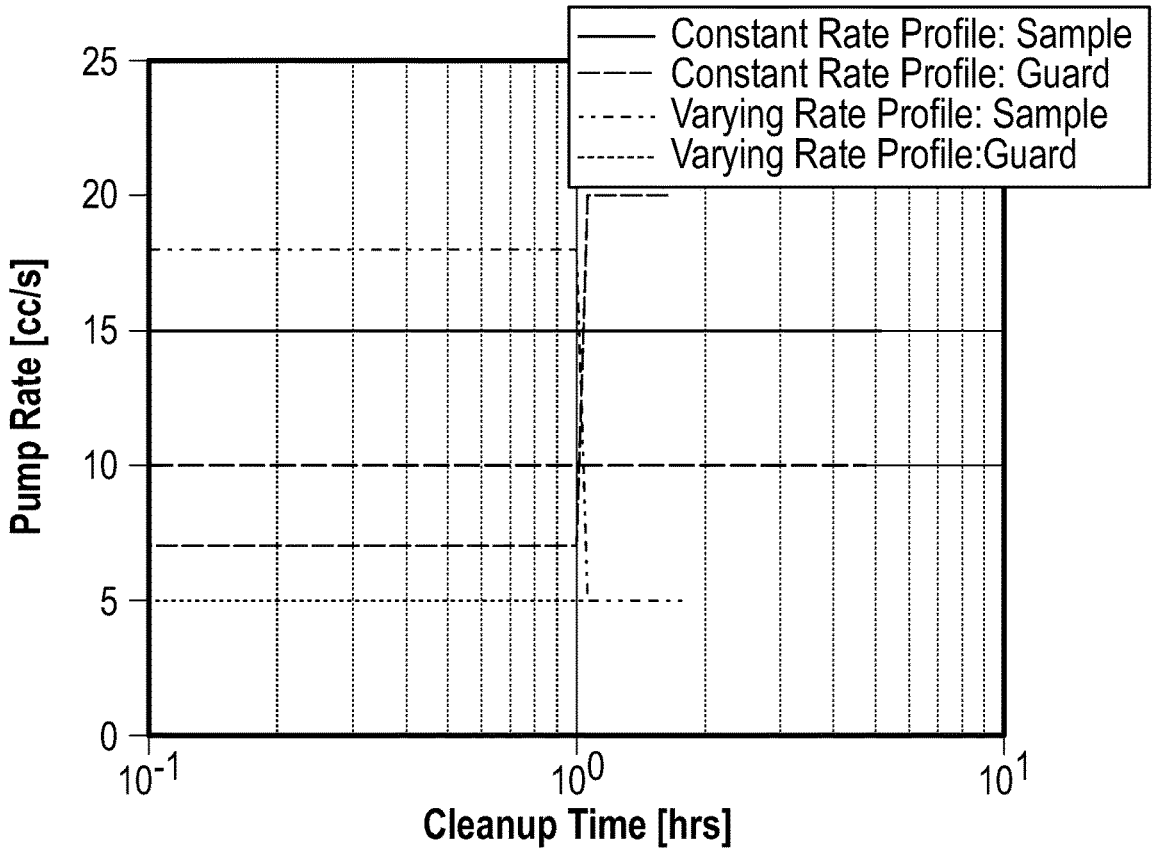

In order to illustrate the potential benefit from optimization of flow rate schedules that minimizes the predicted cleanup time, we compare in FIGS. 10A and 10B two different flow rate strategies for the cleanup operations carried out by a downhole tool with focused sampling hardware tool. In the first case, which is referred to as the "constant rate profile" in FIGS. 10A and 10B, the flow rates are kept constant at 15 cc/s and 10 cc/s for the sample and guard lines, respectively. In the second case, which is referred to as the "varying rate profile" in FIGS. 10A and 10B, after one hour of sampling an optimized rate change is computed by application of the proxy model similar to the method of FIGS. 9A and 9B. In this case, the rates are shifted from the high sample rate and low guard rate to a low sample rate and high guard rate. As can be seen from the FIGS. 10A and 10B, the varying rate profile leads to a cleanup time of 1.5 hours (measured as the time to reach 1% contamination) compared to 5 hours for the constant rate strategy. Hence, a significant time-saving is possible.

Downhole tools that employ focused sampling hardware typically employ a cylindrical guard probe on the periphery of the sampling zone that surrounds the innermost sampling area. An additional packer seal separates the guard intake from the sample intake. The inner and peripheral areas are connected to separate flowlines, called the sample line and guard line, respectively. One or more pumps and valves can control the flow rate of formation fluids that are withdrawn from the formation and flow through the sample and guard lines at different rates, and spectroscopic analyzers and possibly other measurement sensors can determine the fluid properties in each line. In this manner, the focused sampling tool can be configured to withdraw fluid from the formation through the central and peripheral areas of the sampling zone simultaneously. Initially, commingled contaminated fluid flows into both areas, but this fluid is not collected. Fluid flow can then be separated, or split, between the guard and sample lines. In this configuration, fluid flow into the guard line can be increased relative to the fluid flow in the sample line until a clean low-contamination formation-fluid sample flows into and through the sample line. At this point, the clean low-contamination formation-fluid sample that flows into and through the sample line can be subject to fluid analysis that measures properties of the live formation fluid at reservoir conditions and subject to collection into one or more sample containers or vials that can be retrieved from the downhole tool at the surface for laboratory analysis.

Figure 11:
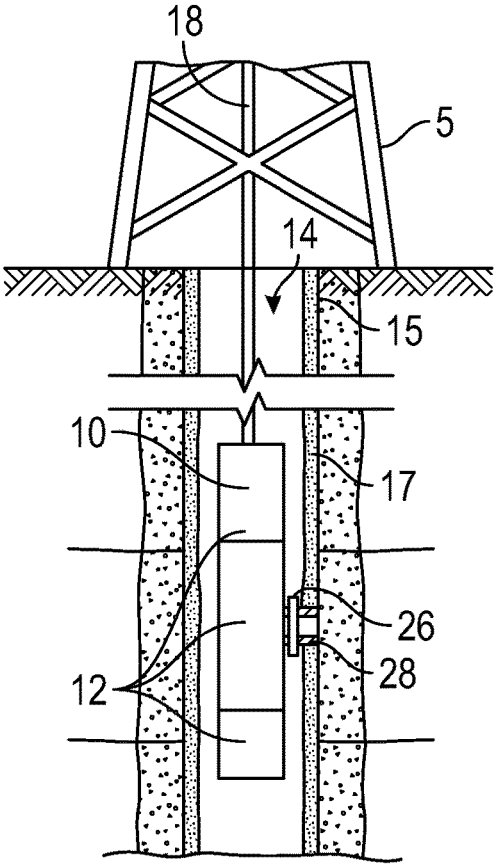
FIG. 11 is a schematic view of an exemplary downhole wireline tool having a fluid sampling and analysis system.

Referring to FIG. 11, an example environment with which aspects of the present disclosure may be used is shown. In the illustrated example, provided is a downhole tool 10, such as a Modular Formation Dynamics Tester (MDT) by Schlumberger Limited, and further depicted, for example, in U.S. Pat. Nos. 4,936,139 and 4,860,581, which are hereby incorporated by reference in their entireties. The downhole tool 10 is deployable into the borehole 14 and suspended therein with a conventional wireline 18, or conductor or conventional tubing or coiled tubing, below a rig 5 as will be appreciated by one of skill in the art. The illustrated downhole tool 10 is provided with various modules and/or components 12, including, but not limited to, a fluid sampling and analysis system 26 used to obtain and analyze formation-fluid samples from the subsurface formation. The system 26 is provided with a probe 28 extendable through the mudcake 15 and to sidewall 17 of the borehole 14. Formation-fluid samples are drawn into the downhole tool 10 through the probe 28. The system 26 also includes flow lines and components that can collect the formation-fluid samples drawn into the downhole tool 10 through the probe 28 and that can perform downhole fluid analysis on formation-fluid samples drawn into the downhole tool 10 through the probe 28.

Figure 12:
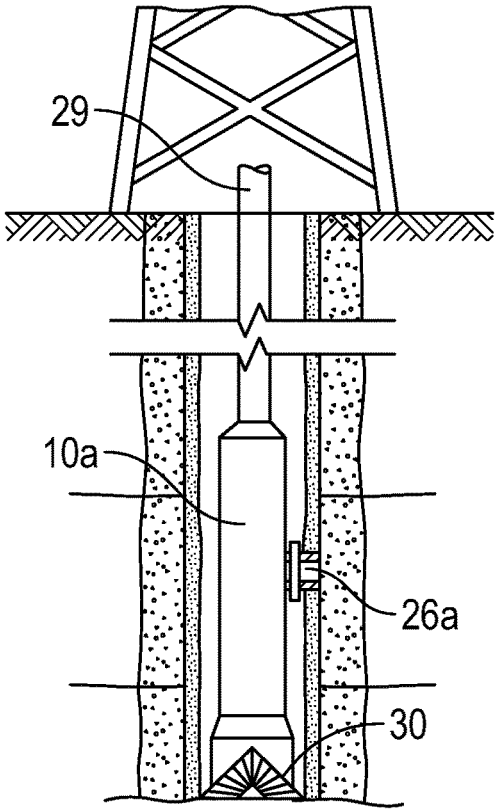
FIG. 12 is a schematic view of an exemplary downhole drilling tool having a fluid sampling and analysis system.

While FIG. 11 depicts a modular wireline tool for collecting and performing in situ analysis of formation-fluid samples according to one or more aspects of the present disclosure, it will be appreciated by one of skill in the art that such system may be used in any downhole tool. For example, FIG. 12 shows an alternate downhole tool 10*a* having a fluid sampling and analysis system 26*a* therein. In this example, the downhole tool 10*a* is a drilling tool including a drill string 29 and a drill bit 30. The downhole drilling tool 10*a* may be of a variety of drilling tools, such as a Measurement-While-Drilling (MWD), Logging-While Drilling (LWD) or other drilling system. The tools 10 and 10*a* of FIGS. 12 and 12, respectively, may have alternate configurations, such as modular, unitary, wireline, coiled tubing, autonomous, drilling and other variations of downhole tools.

Figure 13:
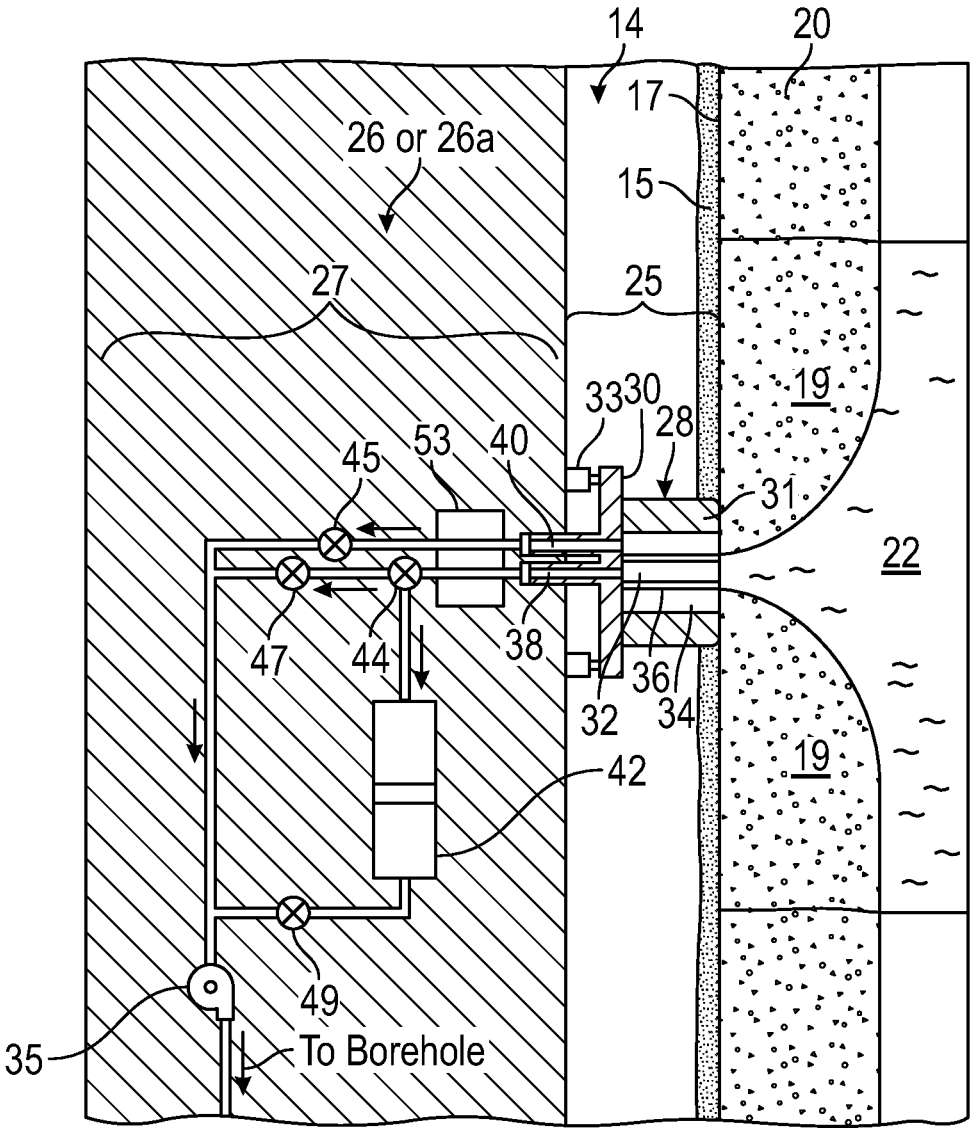
FIG. 13 is a detailed view of the fluid sampling and analysis system of the tools of FIGS. 11 and/or 12.

FIG. 13 illustrates an exemplary embodiment of the fluid sampling and analysis system 26 of FIG. 11 or the fluid sampling and analysis system 26*a* of FIG. 12, which includes an intake section 25 and a flow section 27 for selectively drawing fluid into the desired portion of the downhole tool.

The intake section 25 includes a probe 28 mounted on an extendable base 30 having an outer and inner concentric seals or packers 31, 36 for sealingly engaging the borehole wall 17 around the probe 28. The intake section 25 is selectively extendable from the downhole tool 10 via extension pistons 33. The probe 28 is provided with an interior channel 32 and an exterior channel 34 separated by the wall of the inner seal 36.

The flow section 27 includes a sample line 38 and a guard line 40 driven by one or more pumps 35. The sample line 38 is in fluid communication with the interior channel 32, and the guard line 40 is in fluid communication with the exterior channel 34. The illustrated flow section 27 may include one or more flow control devices, such as the pump 35 and valves 44, 45, 47 and 49 depicted in FIG. 13, for selectively drawing fluid into various portions of the flow section 27. Fluid is drawn from the formation 20 through the interior and exterior channels 32, 34 and into their corresponding flow lines 38, 40.

Initially, an invaded zone 19 surrounds the mudcake 15 and the borehole wall 17. Formation fluid 22 with a sufficiently low level of contamination is located in the formation 20 behind the invaded zone 19. Preferably, contaminated fluid from the invaded zone 19 is drawn through the exterior channel 34 into the guard line 40 and discharged into the borehole 14. Preferably, fluid is drawn into the interior channel 32 through the sample line 38 and either is discharged into the borehole 14 or diverted into one or more sample chambers 42. Once it is determined that the fluid drawn into the interior channel 32 and through the sample line 38 has a sufficiently low level of contamination (and thus is representative of the formation fluid 22), valve 44 and/or valve 49 may be activated using known control techniques to divert the formation fluid from the sample line 38 into the sample chamber(s) 42.

The system 26 is also preferably provided with one or more fluid monitoring systems 53 for analyzing the fluid that enters the probe 28 and flows through the sample line 38 and possibly the guard line 40. The fluid monitoring system 53 may be provided with various monitoring devices or sensors, such as one or more optical spectroscopic analyzers, one or more fluid densiometers, one or more fluid viscometers, and possibly others.

The details of the various arrangements and components of the system 26 described above as well as alternate arrangements and components for the system 26 would be known to persons skilled in the art and found in various other patents and printed publications, such as those discussed herein. Moreover, the particular arrangement and components of the system 26 may vary depending upon factors in each particular design, use or situation. Thus, neither the system 26 nor the present disclosure are limited to the above described arrangements and components and may include any suitable components and arrangement. For example, various geometries for the seals or packers of the probe 28 and corresponding channels can be used and various flow lines, pump placement and valving may be provided for a variety of configurations. Similarly, the arrangement and components of the downhole tool 10 may vary depending upon factors in each particular design, or use, situation. The above description of exemplary components and environments of the tool 10 with which the fluid sampling device 26 of the present disclosure may be used is provided for illustrative purposes only and is not limiting upon the present disclosure.

With continuing reference to FIG. 13, the flow pattern of fluid passing into the downhole tool 10 is illustrated. At some time during the cleanup process as fluid is drawn into the probe 28, the formation fluid 22 breaks through and enters the probe 28. As the fluid flows into the probe 28, the contaminated fluid in the invaded zone 19 near the interior channel 32 is eventually removed and gives way to a flow of the clean formation fluid 22 into the interior chamber 32 and corresponding sample line 38 as shown in FIG. 13.

Figure 14A:
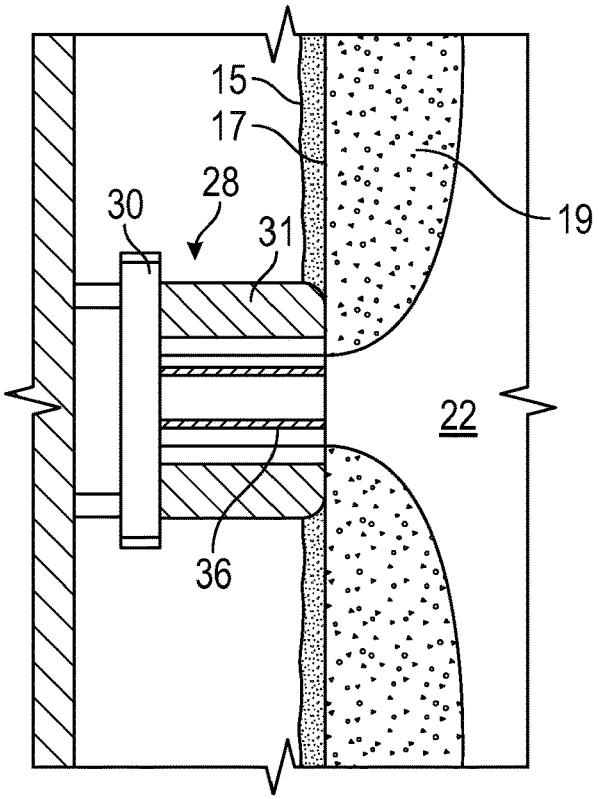
FIGS. 14A and 14B are schematic views of the intake section of the fluid sampling and analysis system of FIG. 13.
Figure 14B:
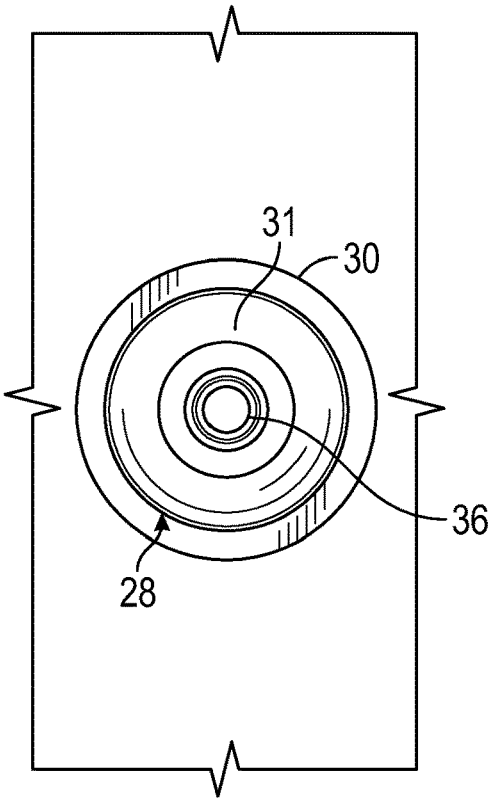

Referring now to FIGS. 14A and 14B, an illustrative embodiment of the probe 28 is shown in greater detail. In FIG. 14A, the base 30 is shown supporting the concentric outer seal 31 and inner seal 36 that penetrates the mudcake 15 in sealing engagement with the borehole wall 17. The inner and outer seals 31, 36 are preferably concentric circles, but may be of alternate geometries depending on the application or needs of the operation. Additional walls, channels and/or flow lines may be incorporated in various configurations to further optimize sampling.

Figure 15:
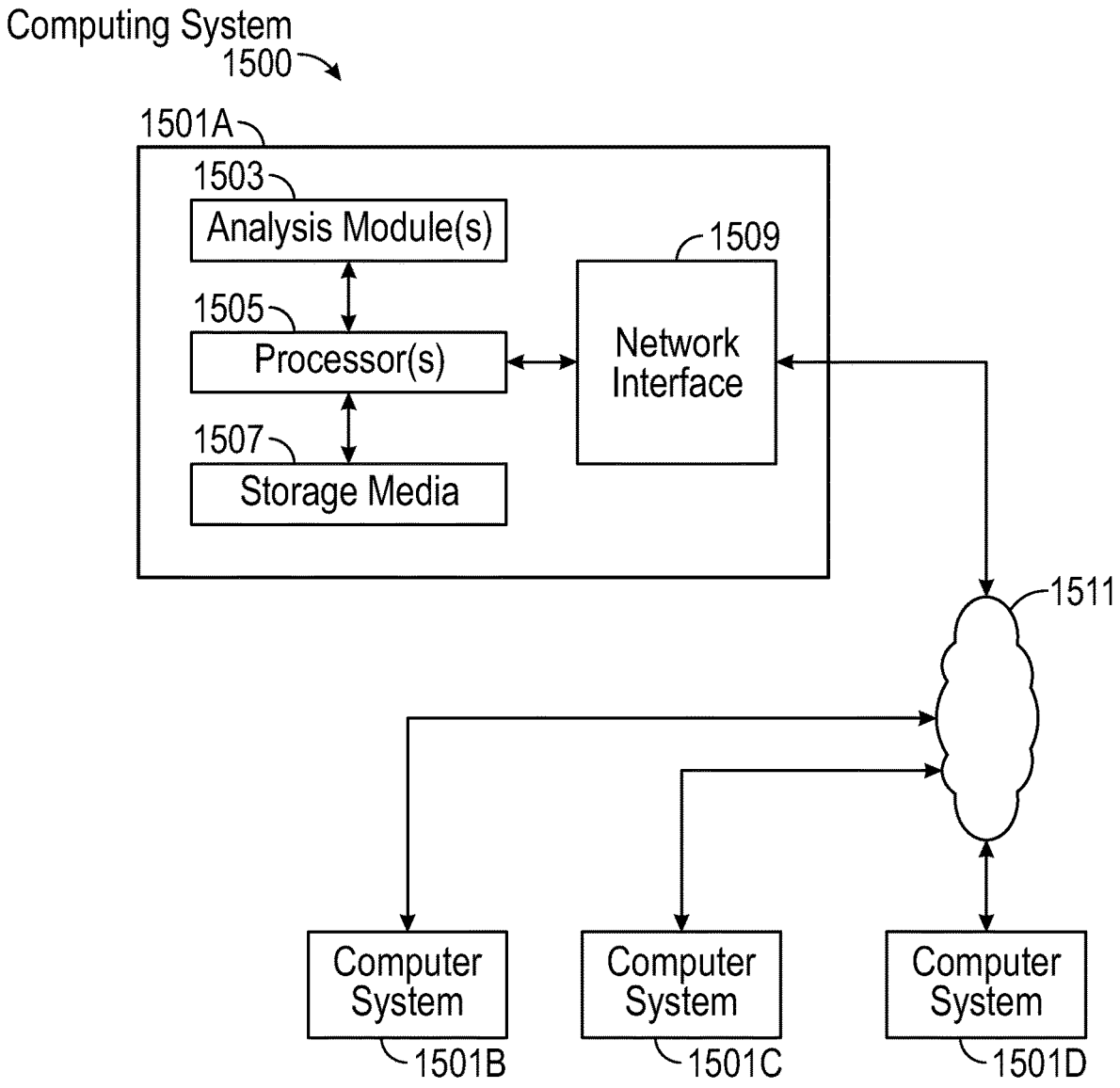
FIG. 15 illustrates an example computing system suitable for carrying out the processes of FIGS. 2, 9A and 9B.

FIG. 15 shows an example computing system 1500 in accordance with some embodiments for carrying out the example processes such as those to be explained above with reference to FIGS. 2 and 9. The computing system 1500 can be an individual computer system 1501A or an arrangement of distributed computer systems. The computer system 1501A includes one or more analysis modules 1503 (a program of computer-executable instructions and associated data) that can be configured to perform various tasks according to some embodiments, such as the tasks described above. To perform these various tasks, an analysis module 1503 executes on one or more processors 1505, which is (or are) connected to one or more storage media 1507. The processor(s) 1505 can also be connected to a network interface 1509 to allow the computer system 1501A to communicate over a data network 1511 with one or more additional computer systems and/or computing systems, such as 1501B, 1501C, and/or 1501D. Note that computer systems 1501B, 1501C and/or 1501D may or may not share the same architecture as computer system 1501A, and may be located in different physical locations, e.g. computer systems 1501A and 1501B may be on a ship underway on the ocean, in a well logging unit disposed proximate a wellbore drilling, while in communication with one or more computer systems such as 1501C and/or 1501D that are located in one or more data centers on shore, other ships, and/or located in varying countries on different continents. Any one or more of the computer systems may be disposed in the well logging instrument (whether wireline as in FIG. 11 or LWD as in FIG. 12).

The processor 1505 can include a microprocessor, microcontroller, processor module or subsystem, programmable integrated circuit, programmable gate array, digital signal processor (DSP), or another control or computing device.

The storage media 1507 can be implemented as one or more non-transitory computer-readable or machine-readable storage media. Note that while in the embodiment of FIG. 15, the storage media 1507 is depicted as within computer system 1501A, in some embodiments, storage media 1507 may be distributed within and/or across multiple internal and/or external enclosures of computing system 1501A and/or additional computing systems. Storage media 1507 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 1503 can be provided on one computer-readable or machine-readable storage medium of the storage media 1507, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions or located at a remote site from which machine-readable instructions can be downloaded over a network for execution.

It should be appreciated that computing system 1500 is only one example of a computing system, and that computing system 1500 may have more or fewer components than shown, may combine additional components not depicted in the embodiment of FIG. 15, and/or computing system 1500 may have a different configuration or arrangement of the components depicted in FIG. 15. The various components shown in FIG. 15 may be implemented in hardware, software, or a combination of both hardware and software, including one or more signal processing and/or application specific integrated circuits.

Further, the operations of the processes described above may be implemented by running one or more functional modules in information processing apparatus such as general-purpose processors or application specific chips, such as ASICs, FPGAs, PLDs, SOCs, or other appropriate devices. These modules, combinations of these modules, and/or their combination with general hardware are all included within the scope of protection of the invention.

Note that some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general-purpose computer) for executing any of the methods and processes described above. Furthermore, the computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

There have been described and illustrated herein several embodiments of a method and corresponding apparatus that perform cleanup operations of as part of a downhole fluid sampling processing. While particular embodiments of the invention have been described, it is not intended that the invention be limited thereto, as it is intended that the invention be as broad in scope as the art will allow and that the specification be read likewise. Thus, while particular configurations of a proxy model for the cleanup operations have been disclosed, it will be appreciated that other computational models for cleanup can be used as well. For example, the computational model can be a proxy model used to characterize the cleanup operations of the downhole tool at constant drawdown pressure. In this case, the proxy model approximates the functional relationship between the cleanup volume and filtrate concentration level at relevant ranges of the input parameters. In this case, it can also approximate the functional relationship between the pump rate and filtrate concentration over relevant ranges of the input parameters. Alternatively, the proxy model as described herein can be substituted by a numerical simulation model of the cleanup process or other type of approximate model of the cleanup process (for example, an analytical model). In addition, while particular types of sampling hardware (such as three-dimensional radial probes and focused probes) have been disclosed, it will be understood that downhole tools with different types of sampling hardware can be used as well. It will therefore be appreciated by those skilled in the art that yet other modifications could be made to the provided invention without deviating from its spirit and scope as claimed.

What is claimed is:

1. A method for downhole fluid analysis of formation fluids, comprising:

using a downhole tool positioned in a wellbore that traverses a subterranean formation, operating the downhole tool to draw a live fluid from the formation through the downhole tool and acquire observed sensor measurements of the live fluid that flows through the downhole tool, wherein the live fluid includes filtrate contamination;

using the observed sensor measurements in an inversion process that solves for a set of input parameter values of a proxy model that predicts a level of filtrate contamination in the live fluid that flows through the downhole tool, wherein the set of input parameter values comprises at least one endpoint value for the observed sensor measurements, wherein the inversion process comprises using at least one objective function chosen from:

$$\min_X \int_V W(V)|\widehat{OD} - OD(x)|dV,$$

wherein $\widehat{OD}$ is an observed optical density, OD(x) is a predicted optical density output by the proxy model, W(V) is a weight-vector, and x is a vector of input parameters including the set of input parameter values and optical density endpoints for the live fluid and a pure filtrate; or $$\min_X \int_V \{W_{OD}(V)|\widehat{OD} - OD(x)| + W_{GOR}(V)|\hat{f} - f(x)| + W_b(V)|\hat{b} - b(x)| + W_\rho(V)|\hat{\rho} - \rho(x)|\}dV,$$

wherein $\widehat{OD}$ is an observed optical density, OD(x) is a predicted optical density output by the proxy model, $\hat{f}$ is an observed GOR-related $f$-function, $f(x)$ is a predicted GOR-related $f$-function output by the proxy model, $\hat{b}$ is an observed shrinkage factor, b(x) is a predicted shrinkage factor output by the proxy model, $\hat{\rho}$ is an observed mass density, $\rho(x)$ is a predicted mass density output by the proxy model, $W_{OD}(V)$, $W_{COR}(V)$, and $W_\rho(V)$ are weight vectors, and x is a vector of input parameters including the optical density endpoints for the live fluid and a pure filtrate and one or more other input parameters; and wherein the inversion is repeated until a stopping criteria is met for the at least one objective function; and storing and outputting the set of input parameter values solved by the inversion process.

2. A method according to claim 1, further comprising:

using the set of input parameter values solved by the inversion process to calibrate the proxy model;

using the calibrated proxy model to predict the level of filtrate contamination in the live fluid; and comparing the predicted level of filtrate contamination to a threshold level and performing at least one operational action of the downhole tool in response to the comparing.

3. A method according to claim 2, wherein:

the threshold level indicates that the live fluid is sufficiently clean; and the at least one operational action is selected from the group consisting of: fluid analysis measurements of the live fluid, collection of at least one sample of the live fluid, or a combination thereof.

4. A method according to claim 1, wherein:

the observed sensor measurements further comprise an additional fluid sensor measurement; and the at least one endpoint value of the set of input parameter values further comprises at least one additional endpoint value of the additional fluid sensor measurement for a clean formation fluid.

5. A method according to claim 4, wherein:

the at least one endpoint value of the set of input parameter values further comprises at least one additional endpoint value of the additional fluid sensor measurement for the filtrate that contaminates the live fluid.

6. A method according to claim 1, wherein:

the set of input parameter values further includes at least one parameter value that characterizes rock properties of the formation.

7. A method according to claim 6, wherein:

the at least one parameter value that characterizes rock properties of the formation comprises at least one parameter value that is based on the vertical permeability $k_v$ of the formation and the horizontal permeability $k_h$ of the formation.

8. A method according to claim 1, wherein:

the set of input parameter values further includes at least one parameter value that characterizes formation fluid properties.

9. A method according to claim 8, wherein:

the at least one parameter value that characterizes formation fluid properties comprises at least one parameter value that is based on uncontaminated formation fluid viscosity $\mu_o$ and filtrate viscosity $\mu_f$.

10. A method according to claim 1, wherein:

the set of input parameter values further includes at least one parameter value that characterizes wellbore properties.

11. A method according to claim 10, wherein:

the at least one parameter value that characterizes wellbore properties is based on at least one of: radius of filtrate invasion as measured from the borehole wall, formation thickness, and relative tool distance from the top of formation.

12. A method according to claim 1, wherein:

the set of input parameter values solved by the inversion process is used to display formation rock properties or formation fluid properties for reservoir understanding.

13. A method according to claim 1, wherein:

the set of input parameter values solved by the inversion process is used as formation rock properties or formation fluid properties for reservoir optimization.

14. A method according to claim 1, wherein:

the observed sensor measurements of the live fluid are carried out with the live fluid flowing from the formation into the downhole tool at a constant rate; and the proxy model predicts the level of filtrate contamination in the live fluid that flows through the downhole tool at the constant rate as a function of cleanup volume.

15. A method according to claim 1, further comprising:

using the at least one endpoint value for the observed sensor measurements as solved by the inversion process to predict the level of filtrate contamination in the live fluid flowing through the downhole tool.

16. A method according to claim 1, wherein:

the proxy model is configured to mimic or represent the output response of a numeric simulation of cleanup operations.

17. A method according to claim 1, further comprising:

using the set of input parameter values solved by the inversion process to calibrate the proxy model;

using the calibrated proxy model to determine at least one optimized rate of fluid flow through the downhole tool which minimizes a predicted remaining cleanup time required to reach a predetermined threshold contamination level; and performing real-time control of the downhole tool such that the flow rate of the live fluid drawn through the downhole tool matches the at least one optimized rate.

18. A method according to claim 17, wherein:

the downhole tool includes a sample line and guard line; and the calibrated proxy model is used to determine a first optimized rate $Q_s$ of fluid flow through the sample line and a second optimized rate $Q_g$ of fluid flow through the guard line, wherein the first and second optimized rates $Q_s$, $Q_g$ minimize a predicted remaining cleanup time required to reach the predetermined threshold contamination level.

19. A method according to claim 18, wherein:

the calibrated proxy model is evaluated over a number of combinations of rates of fluid flow through the sample line and the guard line to determine a predicted remaining cleanup time required to reach a predetermined threshold contamination level for each combination of rates, and the particular combination of rates with a minimum predicted remaining cleanup time is selected as the first and second optimized rates $Q_s$, $Q_g$.

20. A downhole tool configured for fluid analysis of formation fluids, the downhole tool comprising:

at least one fluid sensor that acquires observed sensor measurements of a live fluid that flows through the downhole tool, wherein the live fluid includes filtrate contamination; and at least one processor that is configured to use the observed sensor measurements in an inversion process that solves for a set of input parameter values of a proxy model that predicts a level of filtrate contamination in the live fluid, wherein the set of input parameter values comprises at least one endpoint value for the observed sensor measurements, wherein the at least one processor is further configured to store and output the set of input parameter values solved by the inversion process, and wherein the inversion process comprises using at least one objective function chosen from:

$$\min_X \int_V W(V)|\widehat{OD} - OD(x)|dV,$$

wherein $\widehat{OD}$ is an observed optical density, OD(x) is a predicted optical density output by the proxy model, W(V) is a weight-vector, and x is a vector of input parameters including the set of input parameters and the optical density endpoints for the live fluid and a pure filtrate; or $$\min_X \int_V \{W_{OD}(V)|\widehat{OD} - OD(x)| + W_{GOR}(V)|\hat{f} - f(x)| + W_b(V)|\hat{b} - b(x)| + W_\rho(V)|\hat{\rho} - \rho(x)|\}dV,$$

wherein $\widehat{OD}$ is an observed optical density, OD(x) is a predicted optical density output by the proxy model, $\hat{f}$ is an observed GOR-related $f$-function, $f(x)$ is a predicted GOR-related $f$-function output by the proxy model, $\hat{b}$ is an observed shrinkage factor, b(x) is a predicted shrinkage factor output by the proxy model, $\hat{\rho}$ is an observed mass density, $\rho(x)$ is a predicted mass density output by the proxy model, $W_{OD}(V)$, $W_{GOR}(V)$, and $W_\rho(V)$ are weight vectors, and x is a vector of input parameters including optical density endpoints for the live fluid and a pure filtrate and one or more other input parameters; and wherein the inversion is repeated until a stopping criteria is met for the at least one objective function.

21. A downhole tool according to claim 20, wherein the at least one processor is further configured to:

use the set of input parameter values solved by the inversion process to calibrate the proxy model;

use the calibrated proxy model to predict the level of filtrate contamination in the live fluid; and compare the predicted level of filtrate contamination to a threshold level and initiate at least one operational action of the downhole tool in response to the comparing.

22. A downhole tool according to claim 21, wherein:

the threshold level indicates that the live fluid is sufficiently clean; and the at least one operational action is selected from the group consisting of: fluid analysis measurements of the live fluid, collection of at least one sample of the live fluid, or a combination thereof.

23. A downhole tool according to claim 20, wherein the at least one processor is further configured to:

use the set of input parameter values solved by the inversion process to calibrate the proxy model;

use the calibrated proxy model to determine at least one optimized rate of fluid flow through the downhole tool which minimizes a predicted remaining cleanup time required to reach a predetermined threshold contamination level; and perform real-time control of the downhole tool such that the flow rate of the live fluid drawn through the downhole tool matches the at least one optimized rate.

24. A downhole tool according to claim 23, further comprising:

a sample line and a guard line;

wherein the at least one processor is further configured to use the calibrated proxy model to determine a first optimized rate $Q_s$ of fluid flow through the sample line and a second optimized rate $Q_q$ of fluid flow through the guard line, wherein the first and second optimized rates $Q_s$, $Q_g$ minimize a predicted remaining cleanup time required to reach the predetermined threshold contamination level.

25. A downhole tool according to claim 20, wherein:

the downhole tool comprises a wireline tool.

26. A downhole tool according to claim 20, wherein:

the downhole tool comprises a while-drilling tool.

27. A downhole tool configured for fluid analysis of formation fluids, the downhole tool comprising:

at least one fluid sensor that acquires observed sensor measurements of a live fluid that flows through the downhole tool, wherein the live fluid includes filtrate contamination; and at least one processor that is configured to use the observed sensor measurements in an inversion process that solves for a set of input parameter values of a proxy model that predicts a level of filtrate contamination in the live fluid;

wherein the at least one processor is further configured to use the set of input parameter values solved by the inversion process to calibrate the proxy model, use the calibrated proxy model to determine at least one optimized rate of fluid flow through the downhole tool which minimizes a predicted remaining cleanup time required to reach a predetermined threshold contamination level, and perform real-time control of the downhole tool such that the flow rate of the live fluid drawn through the downhole tool matches the at least one optimized rate, wherein the inversion process comprises using at least one objective function chosen from:

$$\min_{X} \int_{V} W(V)|\widehat{OD} - OD(x)|dV,$$

wherein $\widehat{OD}$ is an observed optical density, OD(x) is a predicted optical density output by the proxy model, W(V) is a weight-vector, and x is a vector of input parameters including the set of input parameter values and optical density endpoints for the live fluid and a pure filtrate; or $$\min_{X} \int_{V} \{W_{OD}(V)|\widehat{OD} - OD(x)| + W_{GOR}(V)|\hat{f} - f(x)| + W_{b}(V)|\hat{b} - b(x)| + W_{\rho}(V)|\hat{\rho} - \rho(x)|\}dV,$$

wherein $\widehat{OD}$ is an observed optical density, OD(x) is a predicted optical density output by the proxy model, $\hat{f}$ is an observed GOR-related $f$-function, $f(x)$ is a predicted GOR-related $f$-function output by the proxy model, $\hat{b}$ is an observed shrinkage factor, b(x) is a predicted shrinkage factor output by the proxy model, $\hat{\rho}$ is an observed mass density, $\rho(x)$ is a predicted mass density output by the proxy model, $W_{OD}(V)$, $W_{GOR}(V)$, and $W_{\rho}(V)$ are weight vectors, and x is a vector of input parameters including optical density endpoints for the live fluid and a pure filtrate and one or more other input parameters; and wherein the inversion is repeated until a stopping criteria is met for the at least one objective function.

* * * * *